US009980867B2

(12) United States Patent
Russell

(10) Patent No.: US 9,980,867 B2
(45) **Date of Patent: *May 29, 2018**

(54) LIMB POSITIONER

(71) Applicant: InnoVision, Inc., Memphis, TN (US)

(72) Inventor: Thomas A. Russell, Memphis, TN (US)

(73) Assignee: Innovision, Inc., Memphis, TN (US)

( * ) Notice: Subject to any disclaimer, the term of this patent is extended or adjusted under 35 U.S.C. 154(b) by 180 days.

This patent is subject to a terminal disclaimer.

(21) Appl. No.: 14/736,969

(22) Filed: Jun. 11, 2015

(65) Prior Publication Data

US 2016/0067129 A1 Mar. 10, 2016

Related U.S. Application Data

(63) Continuation of application No. 13/583,502, filed as application No. PCT/US2011/027660 on Mar. 9, 2011, now Pat. No. 9,056,042.

(60) Provisional application No. 61/311,849, filed on Mar. 9, 2010.

(51) Int. Cl.
*A61G 7/075* (2006.01)
*A61G 13/12* (2006.01)

(52) U.S. Cl.
CPC ..... *A61G 7/0755* (2013.01); *A61G 13/124* (2013.01); *A61G 13/1245* (2013.01); *A61G 13/1235* (2013.01)

(58) Field of Classification Search
CPC ..... A47C 7/506; A47C 16/02; A47C 16/025; A47C 20/021; A61G 7/075; A61G 7/0755; A61G 13/0063; A61G 13/1235; A61G 13/124; A61G 13/1245; A61G 13/125; A61H 1/024
USPC ..... 248/173, 411
See application file for complete search history.

(56) References Cited

U.S. PATENT DOCUMENTS

| | | | | |
|---|---|---|---|---|
| 830,776 | A * | 9/1906 | Flagg | A61G 7/0755 5/648 |
| 1,619,685 | A | 3/1927 | Updegrove et al. | |
| 2,581,110 | A | 1/1952 | Kenworthy | |
| 2,978,713 | A | 4/1961 | Edward et al. | |
| 3,065,992 | A * | 11/1962 | Nagel | A47C 16/025 297/423.46 |
| 3,066,322 | A | 12/1962 | Derby | |
| 3,237,215 | A | 3/1966 | Fried | |

(Continued)

FOREIGN PATENT DOCUMENTS

| | | | |
|---|---|---|---|
| CA | 1049996 | A | 3/1979 |
| CN | 201098225 | Y | 8/2008 |

(Continued)

OTHER PUBLICATIONS

"Japanese Application Serial No. 2016-105729, Response filed Nov. 13, 2017 to Office Action dated Jun. 13, 2017", w/English Translation of claims, 14 pgs.
"U.S. Appl. No. 13/583,502, Non Final Office Action dated Sep. 23, 2014", 9 pgs.

(Continued)

*Primary Examiner* — Nicholas F Polito
(74) *Attorney, Agent, or Firm* — Schwegman Lundberg & Woessner, P.A.

(57) ABSTRACT

The invention features a kit comprising components for a device for positioning and supporting a limb (e.g., an arm or leg) of a patient. The invention also features methods of assembling and adjusting a limb positioning device.

20 Claims, 28 Drawing Sheets

(56) References Cited

U.S. PATENT DOCUMENTS

| | | | | | |
|---|---|---|---|---|---|
| 3,753,557 | A | | 8/1973 | Kelley | |
| 4,373,709 | A | | 2/1983 | Whitt et al. | |
| 5,025,802 | A | | 6/1991 | Laico et al. | |
| 5,063,918 | A | | 11/1991 | Guhl | |
| 5,174,453 | A | * | 12/1992 | Stoeffler | A61B 50/33 206/370 |
| 5,290,220 | A | | 3/1994 | Guhl | |
| 6,021,535 | A | * | 2/2000 | Baus | A47C 7/72 297/217.3 |
| 6,058,534 | A | | 5/2000 | Navarro et al. | |
| 6,263,531 | B1 | | 7/2001 | Navarro et al. | |
| 6,438,777 | B1 | | 8/2002 | Bender | |
| 6,932,783 | B1 | | 8/2005 | Donato | |
| 6,935,992 | B2 | | 8/2005 | Gehrke | |
| 6,962,570 | B2 | | 11/2005 | Callanan et al. | |
| 7,244,238 | B2 | | 7/2007 | March et al. | |
| 7,337,483 | B2 | | 3/2008 | Boucher et al. | |
| 7,381,172 | B1 | * | 6/2008 | Gehrke | A47C 20/021 482/100 |
| 7,534,213 | B2 | | 5/2009 | Shelbourne et al. | |
| 9,056,042 | B2 | * | 6/2015 | Russell | A61G 13/124 |
| 2003/0078144 | A1 | | 4/2003 | Gehrke | |
| 2005/0009678 | A1 | | 1/2005 | Williams, Sr. | |

FOREIGN PATENT DOCUMENTS

| | | | |
|---|---|---|---|
| CN | 201160962 | Y | 12/2008 |
| CN | 201179168 | Y | 1/2009 |
| DE | 29916141 | U1 | 2/2000 |
| EP | 1917950 | A2 | 5/2008 |
| JP | 5726920 | B2 | 6/2015 |
| JP | 2016187563 | A | 11/2016 |
| WO | WO-97/18778 | A1 | 5/1997 |
| WO | WO-9734520 | A2 | 9/1997 |
| WO | WO-2005067859 | A1 | 7/2005 |
| WO | WO-2005072273 | A2 | 8/2005 |
| WO | WO-2008068489 | A1 | 6/2008 |
| WO | WO-2009096899 | A1 | 8/2009 |
| WO | WO-2009/108938 | A1 | 9/2009 |
| WO | WO-2009126032 | A1 | 10/2009 |

OTHER PUBLICATIONS

"U.S. Appl. No. 13/583,502, Notice of Allowance dated Feb. 10, 2015", 7 pgs.
"U.S. Appl. No. 13/583,502, Response filed Jan. 22, 2015 to Non Final Office Action dated Sep. 23, 2014", 19 pgs.
"U.S. Appl. No. 13/583,502, Preliminary Amendment filed Sep. 7, 2012", 12 pgs.
"Australian Application Serial No. 2011224480, Office Action dated Jan. 17, 2014", 3 pgs.
"Australian Application Serial No. 2011224480, Response filed Dec. 16, 2014 to Office Action dated Jan. 17, 2014", 22 pgs.
"European Application Serial No. 11753976.7, Communication Pursuant to Article 94(3) EPC dated Oct. 26, 2015", 5 pgs.
"European Application Serial No. 11753976.7, Decision to grant dated Dec. 1, 2016", 2 pgs.
"European Application Serial No. 11753976.7, Extended European Search Report dated Mar. 3, 2015", 8 pgs.
"European Application Serial No. 11753976.7, Extended European Search Report dated Jul. 17, 2015", 8 pgs.
"European Application Serial No. 11753976.7, Intention to grant dated Jul. 11, 2016", 6 pgs.
"European Application Serial No. 11753976.7, Intention to grant dated Nov. 18, 2016", 126 pgs.
"European Application Serial No. 11753976.7, Response filed May 5, 2016 to Communication Pursuant to Article 94(3) EPC dated Oct. 26, 2015", 15 pgs.
"European Application Serial No. 11753976.7, Response filed Sep. 20, 2015 to Extended European Search Report dated Jul. 17, 2015", 22 pgs.
"International Application Serial No. PCT/US2011/027660, International Preliminary Report on Patentability dated Sep. 20, 2012", 7 pgs.
"International Application Serial No. PCT/US2011/027660, International Search Report dated May 4, 2011", 3 pgs.
"International Application Serial No. PCT/US2011/027660, Written Opinion dated May 4, 2011", 5 pgs.
"Japanese Application Serial No. 2016-105729, Office Action dated May 27, 2016", 77 pgs w/ English Translations.
"Japanese Application Serial No. 2016-105729, Office Action dated Jun. 13, 2017", w/English Translation, 11 pgs.

* cited by examiner

LIMB POSITIONER

FIELD OF THE INVENTION

The invention relates to devices for positioning the extremity of a patient, in particular, a patient's leg or arm, during medical procedures, such as surgery, evaluation, or rehabilitation, and methods of use thereof for the treatment of bone or tissue defects.

BACKGROUND OF THE INVENTION

Many surgical procedures require that a patient's limb or limbs be placed in a number of different positions for the performance of the surgical procedure. It is desirable that the operating surgeon or surgical assistant be able to move the limb into positions and configurations that may be required during the course of the surgical procedure. It is also desirable that any positioning apparatus that may be used to achieve such positions and configurations not obstruct the surgical site or prevent the use of other devices, such as medical imaging systems, operating room lights, instrument trays, or other apparatus.

There are several devices known in the art for supporting the limb(s) (e.g., the arm or leg) of a patient. These supports can be used in a variety of settings. Many of the supports, though, are not adjustable, which limits their therapeutic value to some patients and medical professionals. Of those supports that allow some adjustment, there is generally a lack of full access to areas of the limb during the performance of medical procedures.

In addition, some devices known in the art for supporting the limb of a patient cannot be easily disassembled or collapsed for transport or storage and generally cannot be easily sterilized. Devices currently in use do not satisfactorily meet the need for a limb positioner that is adjustable and that provides easy and full 360° access to desired portions of a patient's limb, such as the patient's knee and portions of the leg surrounding the knee, during, e.g., surgery, evaluation, or rehabilitation.

Thus, there remains a need for a device that adequately supports a patient's limb(s) (e.g., the arm or leg) during, e.g., a surgical procedure, such as knee or elbow surgery, that does not prevent surgical access to the patient's limb, that allows the performance of standard procedures during surgery (e.g., computer-assisted surgery using either electromagnetic or infrared sources of sensor positioning, x-ray imaging, or magnetic resonance imaging (MRI)), and that can be easily sterilized, transported, and stored.

SUMMARY OF THE INVENTION

A first aspect of the invention features a device for supporting an extremity of a patient (e.g., the arm, leg, hand, foot, and the joints of the extremities). The device is configured to support the limb of a patient (e.g., the arm or leg). The device includes a) a substantially planar base structure that includes first and second base supports that form two opposite sides of the base structure; b) a first limb support structure that includes first and second raised supports and a first limb support bar, in which the first raised support is rotatably connected at one end to the first base support, the second raised support is rotatably connected at one end to the second base support, and the first limb support bar is movably attached at or near its ends to the first and second raised supports; and c) a second limb support structure that includes third and fourth raised supports and a second limb support bar, in which the third raised support is rotatably connected at one end to the first base support, the fourth raised support is rotatably connected at one end to the second base support, and the second limb support bar is movably attached at or near its ends to the third and fourth raised supports.

In an embodiment of the first aspect of the invention, the first and second base supports are substantially parallel to one another. For example, the first and second base supports are oriented at no more than about a 60° angle (e.g., an angle of about 0° to about 60°) relative to each other, and preferably the first and second base supports are oriented at an angle of about 0° (i.e., parallel) to about 25° relative to each other. In another embodiment, the first and second base supports can have a length in the range of about 10 to about 100 cm (e.g., the first and second base supports can be about 10, 20, 30, 40, 50, 60, 70, 80, 90, or 100 cm in length or can have a length in the range of about 10 to about 60 cm). In an embodiment, the first and second base supports have the same or different lengths. In another embodiment, the first and second base supports have a length that is greater than the length of the third and fourth base supports.

In other embodiments, the substantially planar base structure is a single solid, planar support surface (e.g., the first and second base supports are connected to each other along their entire length and constitute two opposite edges of the single solid planar support surface, or are connected along a portion of their entire length or at various points along their entire length). Alternatively, the first and second base supports of the substantially planar base structure can include one or more support members that remain within the plane of the base structure and that connect the first and second base supports at various points. In yet other embodiments, the first and second base supports of the planar base structure increase in height from the proximal end of the device (i.e., from the end of the device configured to be positioned closest to the torso of the patient) to the distal end of the device (i.e., from the end of the device configured to be positioned furthest from the torso of the patient). For example, the first and second base supports can have a sloping or wedge shape (e.g., having an angle of about 1-10° or an increase in height from end to end across the base supports of about 1 to 5 cm).

In yet other embodiments, the base structure of the device further includes third and fourth base supports that are substantially parallel to one another, and the first, second, third, and fourth base supports are connected at their ends substantially in the form of a parallelogram (e.g., in the form of a square, rectangle, rhomboid, or rhombus) to form the base structure. The third and fourth base supports can have a length in the range of about 10 to about 100 cm (e.g., the third and fourth base supports can be about 10, 20, 30, 40, 50, 60, 70, 80, 90, or 100 cm in length or can have a length in the range of about 10 to about 60 cm). In other embodiments, the third and fourth base supports may be oriented substantially parallel to each other (e.g., at an angle of about 0°), or either or both may be curved inward or outward relative to the patient's torso, e.g., in an arc, relative to one another.

In several other embodiments, the raised supports of the device are the same length or different lengths. For example, each of the first and second raised supports can be the same length as, shorter than, or longer than, the third and fourth raised supports. In another embodiment, the first raised support is the same length as, shorter than, or longer than, the second raised support. In yet another embodiment, the third raised support is the same length as, shorter than, or longer than, the fourth raised support. In other embodiments, the raised supports are, e.g., about 5 cm to about 100 cm in length, preferably about 10 cm to about 100 cm in length, and more preferably about 10 cm to about 60 cm in length.

In another embodiment, the first limb support structure of the device is rotatably connected to the first and second base supports substantially at two corners of the base structure, and the second limb support structure is rotatably connected to the first and second base supports substantially at the opposite two corners of the base structure. In yet other embodiments, the first and second limb support structures of the device are rotatably connected to the base structure at a position other than at the corners formed from the intersection of the first and second base supports with the third and fourth base supports. The first, second, third, and fourth base supports can be connected at their ends by releasable (or non-releasable) connectors that allow (or prevent) disassembly of the base structure. Alternatively, the first, second, third, and fourth base supports are joined without seams or connectors.

In yet other embodiments, one or more of the first, second, third, and fourth raised supports are rotatably connected to the base supports by limb support structure connectors that can be movable, rotatable, or both. The limb support structure connectors can allow movement of the raised supports along the length of the first and second base supports, such that the distance between the first and second limb support structures along the first and second base supports can be increased or decreased. The limb support structure connectors can also allow rotation of the raised supports relative to the first and second base supports (e.g., the angle between the raised supports and the base structure can be increased or decreased). For example, the limb support structure connectors allow rotation of the first and second limb support structures toward or away from the plane defined by the base structure. By rotating the first and second limb support structure using the limb support structure connectors, the first and second limb support structures can be oriented relative to the first and second base supports at an angle from about 0° to about 180° (e.g., an angle of about 30°, 50°, 70°, 90°, 100°, 120°, 140°, 160°, and 180° between the plane of a limb support structure and the plane of the base structure). In particular, the first and second limb support structures are configured so that they can rotate into an interior region of the base structure (e.g., to produce a substantially flat, collapsed structure that can be easily stored and transported; see, e.g., FIGS. 4A and 4B). The interior region of the base structure may be defined as the region between the first and second base supports and, if third and fourth base supports are present, the interior region may be further defined as the region between the first, second, third, and fourth base supports.

In other embodiments, the limb support structure connectors of the raised supports can be tightened to prevent movement, rotation, or both of the raised supports of the first and second limb support structures when the device is in use, e.g., during support of the limb of a patient. If desired, the limb support structure connectors of the raised supports can be loosened to allow movement of the raised supports along all or a portion of the length of the first and second base supports. For example, when the limb support structure connectors of the first and second raised supports are loosened, the first limb support structure can be moved toward or away from the second limb support structure by pushing the first and second raised supports along the first and second base supports. Once the first limb support structure is located at the desired position, the limb support structure connectors of the first and second raised supports can be retightened. Alternatively, the limb support structure connectors of the first and second raised supports can be loosened such that the first limb support structure is completely disengaged from the first and second base supports. The first limb support structure can then be restored to a position on the first and second base supports by fitting the ends of the first and second raised supports that were previously connected to the first and second base supports via the limb support structure connectors and retightening the limb support structure connectors (e.g., by hand or by tool) to firmly secure the limb support structure to the base structure.

In an embodiment, the limb support structure connectors are configured so that the movement and/or rotation properties provided by the limb support structure connectors are independent. For example, the limb support structure connectors of the device can be configured to include two separate mechanisms that can be tightened and loosened: a first mechanism that, when loosened, allows the raised supports to be rotated only (and when tightened secures the device against rotation of the raised supports), and a second mechanism that, when loosened, allows the raised supports to be moved along (or removed from) the base supports (and when tightened secures the device against movement of the raised supports along the length of the base supports). Consequently, the device of the invention can include limb support structure connectors having two mechanisms that independently adjust the movement and rotation, respectively, of the raised supports or limb support structure connectors having only a single mechanism that adjusts both the movement and rotation of the raised supports.

The device of the invention can also include at least one first locking support that releasably connects one of the raised supports of the first and second limb support structures to the first or second base supports. The device can also include additional first locking supports that releasably connect some or all of the raised supports (e.g., two, three, or four of the raised supports) to the base structure. The first locking support can be, e.g., a rod, and may include, e.g., a locking hinge, a locking spring, or other mechanism. If present, the first locking support can be used to secure one or more of the raised supports to the base supports. The locking support can be secured to the raised support and the base support using a connector that allows engagement and disengagement of the locking support by the user. Once engaged, the locking support should provide additional support to the device when in use. After use, or during adjustment of the components of the device, the locking support connector can be disengaged to enable adjustment, e.g., of the raised support, and reengaged once the raised support has been placed in a desired position.

The device of the invention may also include at least one second locking support that secures the raised supports of the first and second limb support structures of the second base support to each other. The device may include two, three, four, or more second locking supports. The second locking support can be, e.g., a rod, and may include, e.g., a locking hinge, a locking spring, or other mechanism.

In yet another embodiment, the device of the invention can include at least one third locking support with perforations that allows rods to fix the limb of the patient (e.g., arm or leg) in a box frame. The device may include two or more third locking supports.

The device of the invention may include only first, second, or third locking supports or it may include combinations of the first, second, and third locking supports (e.g., one or more first and second locking supports, one or more first and third locking supports, one or more second and third locking supports, or one or more first, second, and third locking supports).

The device can also include raised supports that are telescoping and configured to be extended and retracted (e.g., to about 5 cm to about 20 cm in length). The telescoping supports can also include positioners that provide attachment points for the first and second limb support bars. In another embodiment, the base structure can also include additional telescoping legs (e.g., one, two, three, or four or more telescoping legs) that can be extended or retracted (e.g., to about 5 cm to about 20 cm in length). These telescoping legs can be used, e.g., to level the device when in use or to raise the device.

In other embodiments, the first and second limb support bars are attached to the raised supports by releasable connectors, each of which can be independently engaged and disengaged to allow movement of the first and second limb support bars along the length of the raised supports. When engaged, the releasable connectors prevent movement of the limb support bars, e.g., when pressure is applied to the limb support bar by, e.g., the weight of a limb of a patient. To move the limb support bar, the releasable connectors at one or both ends of the limb support bar are disengaged and the limb support bar is moved along the raised support(s) to a desired height. The releasable connectors can be reengaged to secure the limb support bar at the chosen height. The releasable connectors can be configured so that, once disengaged, the limb support bars of the device of the invention can be completely separated from the device. Alternatively, the releasable connectors can be configured so that, once disengaged, the limb support bars of the device of the invention can move freely up and down the raised supports, but cannot be completely separated from the device.

In yet other embodiments, the limb support bars are substantially linear, curved (e.g., the ends of the limb support bars may be curved away from the base structure to create an arcuate shape), or have other shapes and forms that do not interfere with the ability of the limb support bar to support the limb of a patient. The first limb support bar may also have an orientation that is substantially perpendicular to the first and second raised supports and substantially parallel to the plane defined by the base structure, while the second limb support bar may have an orientation that is substantially perpendicular to the third and fourth raised supports and substantially parallel to the plane defined by the base structure. The limb support bars may have a length of about 10 cm to about 60 cm and any length in between (e.g., a length of about 10 cm to about 30 cm). The first and second limb support bars may be independently moved along the length of the raised supports. The height of the first support bar may be the same as or different than the height of the second limb support. In addition, the first limb support bar may be the same length as, longer than, or shorter than, the second limb support bar.

In other embodiments, the first raised support of the device can be secured to the first limb support bar at or near its end (e.g., at a point that is about 10 cm of less (e.g., about 5 cm, 4 cm, 3 cm, 2 cm, 1 cm, 0.5 cm, 0.25 cm, or less) from the end of the first limb support bar). Similarly, the second raised support can be secured to the first limb support bar at or near its other end (e.g., at a point that is about 10 cm of less (e.g., about 5 cm, 4 cm, 3 cm, 2 cm, 1 cm, 0.5 cm, 0.25 cm or less) from the other end of the first limb support bar) using, e.g., a releasable connector. The second limb support bar can be secured to the third and fourth raised supports in the same manner as described above for the first limb support bar. The first and second limb support bars can be secured to the raised supports using, e.g., a releasable connector or through holes in the limb support bars that bisect the central axis of the limb support bars. For example, the limb support bars can be secured to two of the raised supports by sliding the ends of two of the raised supports (e.g., the first and second raised supports or the third and fourth raised supports) through the two holes in one of the limb support bars. The limb support bars can then be secured to the raised supports at a chosen height by, e.g., a clamp, a pin, a bracket, a disc, a screw, or the like.

In another embodiment, the first and second limb support bars are secured to the raised supports using releasable connectors that are configured to allow rotation of the limb support bars about their longitudinal axis. The releasable connectors may also be configured to be tightened by hand or by tool to prevent movement of the limb support bars during use of the device (e.g., to support the limb of a patient). In an embodiment, the limb support bars are removably attached to the raised supports.

The device of the invention may also include two or more positioners along the length of the raised supports. The positioners, which can include grooves, holes, or indentations at pre-set locations along all or a portion of the length of the raised supports, can be used to secure the first and second limb support bars at the pre-set locations. In other embodiments, the releasable connectors of the first and second limb support bars further include a locking member (e.g., a pin, a disc, a screw, a bracket, a clamp, or the like) configured to fit within the grooves, holes, or indentations to lock the limb support bars at the pre-set location along the raised supports.

In several embodiments, the first and second limb support bars or the raised supports have a substantially circular, substantially triangular, or substantially square cross-sectional shape along all or a portion of their lengths; the base supports, raised supports, or limb support bars may have the cross-sectional shape along substantially all, or only a portion, of their lengths. The base supports, raised supports, or limb support bars may also be formed with a slight curvature (e.g., an arcuate bend of about 30° or less (e.g., an arcuate bend of about 25°, 20°, 15°, 10°, 5°, or less)). In another embodiment, the base supports, raised supports, or limb support bars have a cross-sectional shape that is substantially polygonal along all or a portion of their lengths.

In other embodiments, all or a subset of the components of the device are manufactured using radiolucent materials, metallic components, non-metallic components (e.g., plastic components, such as thermo polymer materials (e.g., USP Class VI thermo polymer materials, such as RADEL® sulfone polymers (e.g., RADEL® polyphenylsulfone (PPSU), Solvay Advanced Polymers)), non-magnetic components, or paramagnetic components (e.g., titanium, preferably instrument grade titanium). The devices of the invention can be made using non-electromagnetic materials, and thus the devices can be used with computer-assisted surgery (e.g., computer-assisted surgical navigation and targeting systems using, e.g., electromagnetic or infrared sources of sensor positioning requiring nonmagnetic support structures for the limb and surgical field), x-ray imaging or x-ray guided surgery, or magnetic resonance imaging (MRI) procedures.

In yet other embodiments, the device is sterile or can be sterilized using, e.g., radiation, chemicals, heat, or pressure (e.g., in an autoclave). Once sterilized, the device device can be maintained in a contamination-free manner in a sealed material.

In other embodiments, the limb is an arm or leg of a patient (e.g., a human patient). In an embodiment, the limb is a leg and the first limb support bar is configured to support the portion of the leg above the knee of the patient and the second limb support bar is configured to support the portion of the leg below the knee of the patient.

A second aspect of the invention features a method of supporting and positioning a limb (e.g., an arm or leg) of a patient (e.g., a human patient) by placing the limb of the patient across the limb support bars (e.g., the first and second limb support bars) of the device of the first aspect of the invention. In an embodiment, the method includes positioning the portion of the leg of the patient between the hip and the knee along a top surface of the first limb support bar and positioning the portion of the leg of the patient between the knee and the ankle along a top surface of the second limb support bar. In other embodiments, the limb may be secured to the first and second limb support bars using, e.g., straps, wraps, buckles, VELCRO®, snaps, or other fasteners or material. The method allows access to the patient's extremities (e.g., the arm, leg, hand, foot, and the joints of the extremities) during surgery, evaluation of the extremity (e.g., prior to or after surgery), and rehabilitation of the extremity.

In another embodiment, the method includes performing surgery on, evaluating, or rehabilitating the limb or extremity of the patient. In yet another embodiment, the surgery is for the treatment or repair of a bone defect, e.g., fracture fixation (which may or may not involve osteoplasty) or knee surgery, e.g., to repair an ACL tear. In another embodiment, the device is used to position the limb of a patient for use in vascular surgery. For example, the device of the invention may be used by a plastic surgeon to assist in the removal of skin for a skin graft or in the placement of a skin graft on the limb of a patient (e.g., a burn patient). In yet another embodiment, the device is used to position the limb of a patient for use in the treatment or repair of soft tissue, ligament, or cartilage. In still other embodiments, the device can be used in reconstructive procedures on the extremity of a patient (e.g., an arm or leg). Particular uses include, e.g., osteoplasty, deformity correction, surgical treatment of osteomyelitis, and tumor surgery.

A third aspect of the invention features a kit that includes an assembled or disassembled device of the first aspect of the invention. In an embodiment, the device (in assembled or disassembled form) is packaged in a sterile or sterilizable material.

DEFINITIONS

As used herein, the term "about" means±10% of the recited value.

By "bone defect" is meant any bone deficient region, such as a void, gap, recess, or other discontinuity in a bone. A bone defect can be artificially or naturally established, and can occur, for example, due to disease or trauma. Thus, a bone defect can occur as a consequence of pathologic or inflammatory diseases, formation and/or removal of a bone tumor, a surgical intervention, a congenital defect, or a bone fracture, and the like. For example, in the case of certain diseases, such as bone tumors, the bone defect may be artificially established due to removal of the tumor tissue. The bone screws of the invention can be applied, for example, in the repair of periodontal defects, in craniofacial or maxillofacial surgery or reconstruction, in hand surgery, in joint reconstruction, in fracture repair, in orthopedic surgical procedures, and in spinal fusion. The term "bony defect" is also intended to include anatomical sites where augmentation to a bony feature is desired by the patient in the absence of disease or trauma, such as in elective cosmetic surgery. Thus, the "defect" can be one that is subjectively perceived by the patient, and where augmentation of the bone deficient region is desired.

By "osteoplasty" is meant any procedure in which bone fill material and/or a flowable medium is delivered into the interior of a bone.

By "substantially" is meant±10% of the recited value or ±10° of a recited angle, including a recited orientation (e.g., parallel or perpendicular orientations).

By "treating" or "treatment" is meant the medical management of a patient with the intent that an amelioration, repair, or prevention of an injury or disease, pathological condition, or disorder will result. This term includes active treatment, that is, treatment directed specifically toward improvement of the injury or disease, pathological condition, or disorder, and also includes causal treatment, that is, treatment directed toward removal of the cause of the injury or disease, pathological condition, or disorder. In addition, this term includes palliative treatment, that is, treatment designed for the relief of symptoms rather than the curing of the injury or disease, pathological condition, or disorder; preventive treatment, that is, treatment directed to prevention of the injury or disease, pathological condition, or disorder; and supportive treatment, that is, treatment employed to supplement another specific therapy directed toward the improvement of the injury or disease, pathological condition, or disorder.

Other features and advantages of the invention will be apparent from the drawings, the following detailed description, and from the claims.

DETAILED DESCRIPTION OF THE INVENTION

Figure 1:
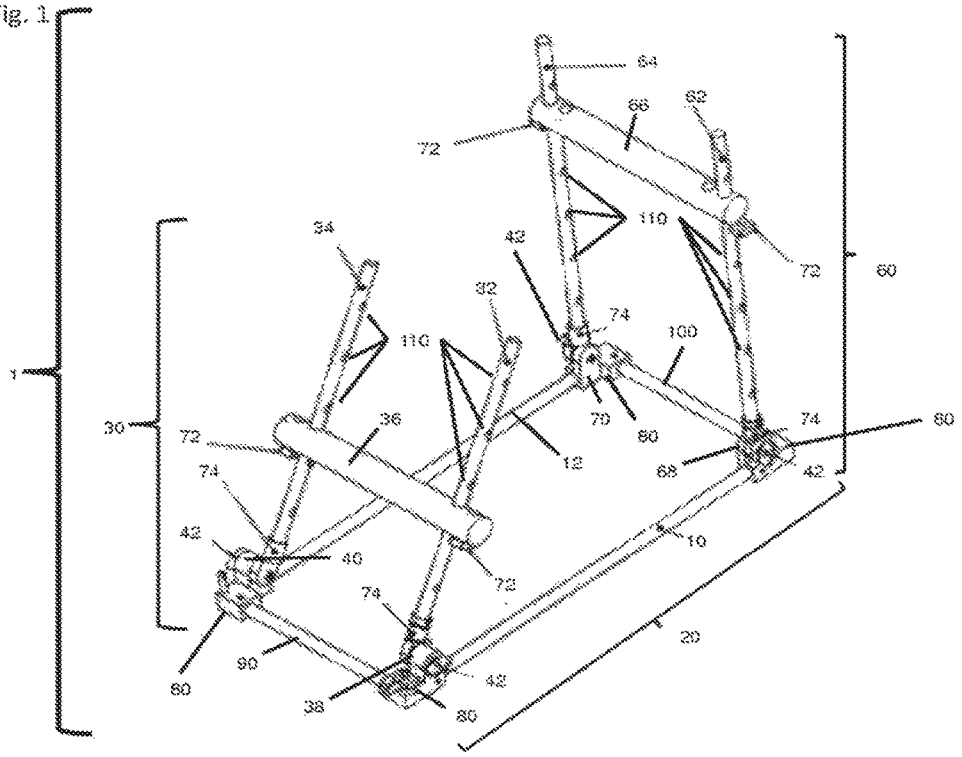
FIG. 1 is perspective view of a device of the invention.

The invention features devices that support and position the limb (e.g., an arm or a leg) of a patient (e.g., a human patient). In particular, the invention features a device that positions and supports the leg above and below a patient's knee so as to provide easy and free access to the patient's knee and portions above and below the knee. The device is adjustable to many different positions and heights through the use of multiple independent adjustment mechanisms. The limb support structures of the device of the invention can be adjusted according to several different criteria, including height, length, and angular position relative to the base structure of the device. The device can be used to position and support one leg or arm of a patient only or, if necessary, both legs or arms of a patient simultaneously.

The devices of the invention offer several benefits, including the following:

- Provides stability and control of the lower extremity for fixation;
- Utilized and adjustable within the sterile field after prep and drape;
- Easy to disassemble, clean and sterilize;
- Built with durable and long lasting materials;
- Allows for 360° access to the lower extremity;
- Holds the lower extremity in a stable position allowing the C-arm to rotate easily between AP and Lateral position;
- Provides hands-free support of the lower extremity; and
- Clinically proven to be nonmagnetic for use with computer assisted navigation and targeting systems.

The device provides a dependable, stable base on which to perform lower extremity surgery. The use of, and the positioning of the patient and their extremity on, the device may be based on the preference of, e.g., the surgeon. The device is designed to be flexible, and may be adjusted to fit the size and shape of the patient and the desired position for the particular surgery that is being performed.

The device can be manufactured using lightweight materials. The device is also manufactured in a configuration, or with materials, that allow it to be easily disinfected (e.g., by radiation, chemicals, heat, or high pressure (e.g., by autoclaving)). The device of the invention can also be configured to be collapsed to a relatively compact or flat position for ease in transport, storage, and sterilization, and disassembly. The device can be made from a variety of materials, such as radiolucent materials and non-magnetic and paramagnetic materials. The device shown in FIGS. 7-16 is made using titanium (base supports and base support connectors (frame base), raised supports (12" and 15" goal posts), limb support structure connectors (outer and inner thumb screws), tighteners (outer and inner pivot locks), and metal tees) and RADEL® sulfone polymers (limb support bars (multi-hole bars and solid limb support bar) and elongated connecting tees).

The present invention provides a device that includes only a few parts and the parts are easy to manufacture, assemble and operate. The elevation and relative orientation of the structures of the device that support the upper and lower extremities of the limb can be independently adjusted to suit the specific needs of the patient and the treating physician. Once the desired adjustment is made, the structures of the device can be secured in place, by, e.g., tightening or locking one of several different connectors of the device so that the device is stable during use and does not allow or minimizes unnecessary movement of the limb during, e.g., surgery, evaluation, or rehabilitation.

The positioner device of the present invention can be manufactured from commercially available components, machined parts, extrusions and drawn shapes. Examples of suitable material include steel and aluminum, although it is obvious that any of a number of different materials could be substituted. For example, the device of the invention can be constructed of lightweight materials, such as plastic (e.g., molded plastic, such as thermoformed, rotomolded, and/or injection molded plastic, plastic pipe, such as polyvinyl chloride (PVC) pipe), but other materials such as lightweight aluminum material or titanium can also be used in the manufacture of all or portions of the device. In other embodiments, the device can be constructed, in whole or in part, using radiolucent materials (e.g., a radiolucent plastic, such as acetal, RADEL®, or other high strength plastics, such as PEEK® plastic (Polyetheretherketon; available from Whitford Worldwide Company, Del., USA), aluminum, carbon fibers, glass, aramid (Kevlar-29), and epoxy matrices) that permit the passage of x-rays through the device. Minor structural elements such as springs, pins, connectors, or the like not directly in the path of the x-rays may be made of metal, but it is desirable to eliminate the use of metal, if possible. A device of the invention can also be constructed using combinations of the materials described herein (e.g., combinations of titanium and RADEL®).

The device can be manufactured such that it has directional cues indicating which part of the device should be used to support the portion of the patient's limb closest to their torso and which portion of the device should be used to support the portion of the patient's limb farthest from their torso. For example, the device can include arrows indicating the direction in which the patient's limb should be positioned (e.g., the arrow pointing in the direction in which the patient's extremities should be placed). Alternatively, the device can be designed to be narrower at the portion closest to the patient's torso and wider at the portion furtherest from the patient's torso (or vice versa). As an example, the raised supports of the first limb support structure of the device can be shorter in length relative to the raised supports of the second limb support structure, thereby indicating that the first limb support structure is located at the proximal end of the device and the patient's limb closest to the torso should be supported at that end. Similarly, the second limb support structure can be longer in length relative to the raised supports of the first limb support structure, thereby indicating that the second limb support structure is located at the distal end of the device and the patient's limb furthest from the torso should be supported at that end.

Figure 20:
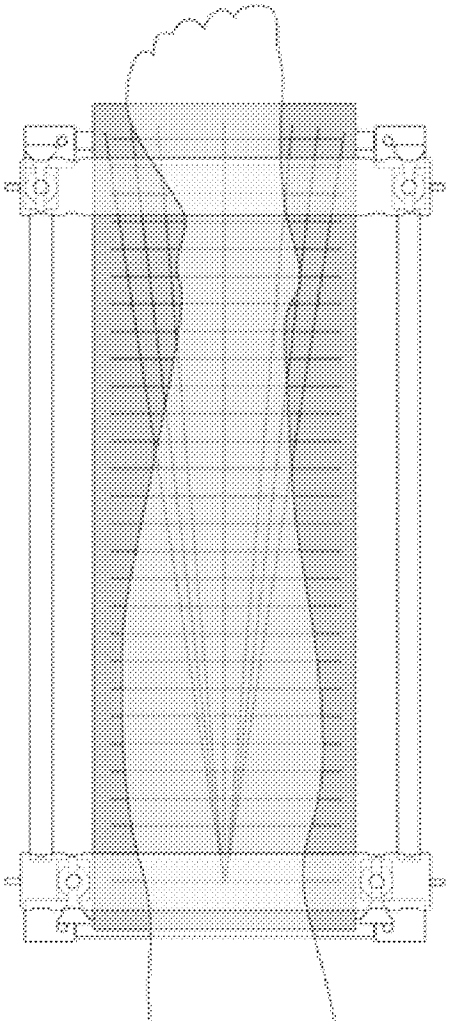
FIG. 20 is a top down view of an alignment guide (showing radiographic lines).
Figure 21:
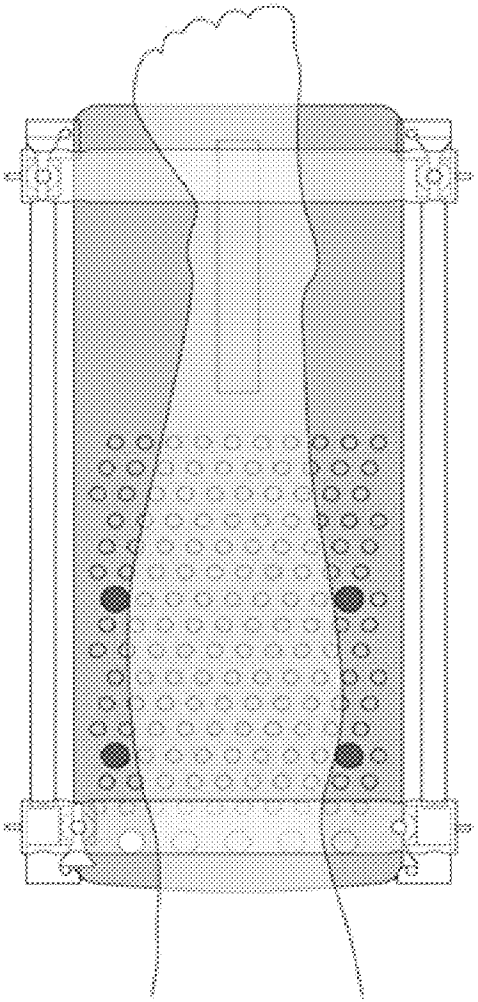
FIG. 21 is a view showing an alignment guide configured to be a fracture reduction platform. The alignment guide includes holes and pegs that can be used to reduce a fracture while helping to align the leg.

The device can also be manufactured to include alignment guides, such as those shown in FIGS. 20 and 21. These guides can be used to help position and stabilize the extremity. The guides can also be used to confirm that the extremity (e.g., a leg) is straight and can assist in lining the knee up with the ankle joint. The alignment guides can be positioned underneath the device, on top of the device, or at an intermediate position between the top and bottom of the device. The alignment guides can include straight parallel lines or lines that converge at a single point (see, e.g., FIG. 20).

In another embodiment, the limb positioner device of the invention is designed to be collapsible, which allows the device to be easily stored when not in use or transported to a site for use. The device can also be collapsed to facilitate its sterilization, e.g., in an autoclave. In addition, the device can be readily manufactured with connectors that allow the device to be easily assembled and disassembled, if necessary.

In another embodiment, the positioner device of the invention is lightweight, yet sturdy, which facilitates storage, transfer, and sterilization of the device.

In yet another embodiment, first limb support structure 30 and second limb support structure 60 of the device of the invention (see, e.g., FIGS. 1 and 2) are configured to be independently adjustable in several different ways. For example, adjustments can be made to the height of limb support bars 36 and 66 (see, e.g., FIGS. 1 and 2), the distance of first limb support structure 30 relative to second limb support structure 60 along the length of base supports 10 and 12, and the angle of first 30 or second 60 limb support structure with respect to base supports 10 and 12. In addition, raised supports 32, 34, 62, and 64 can have telescoping arms that can be extended and retracted so as to increase or decrease their length, and, by extension, the height of limb support bars 36 and 66 (see, e.g., FIG. 22). These adjustments of the various structures of the device of the invention facilitate positioning of the device to maximize the comfort of the patient and access to the limb of the patient (e.g., the patient's knee (or portions above and below the knee) or elbow (or portions above and below the elbow)) by a treating physician during, e.g., surgery, evaluation of a bone defect, or rehabilitation after treatment of a bone defect or revision surgery.

The device of the invention can also be configured to include one or more telescoping legs, e.g., attached to the base support structure, that enable the device to be raised or lowered, as necessary. Alternatively, as discussed above, the raised supports (e.g., the first, second, third, or fourth raised supports) of the device may be telescoping, which would allow the first and second limb support structures to be raised and lowered, as necessary, to adjust the position of the patient's leg(s) or arm(s). When extended, the telescoping portion of the device can be locked into place by any of a number of materials, e.g., pins, screws, tighteners, gears, springs, clamps, or other components.

Figure 18:
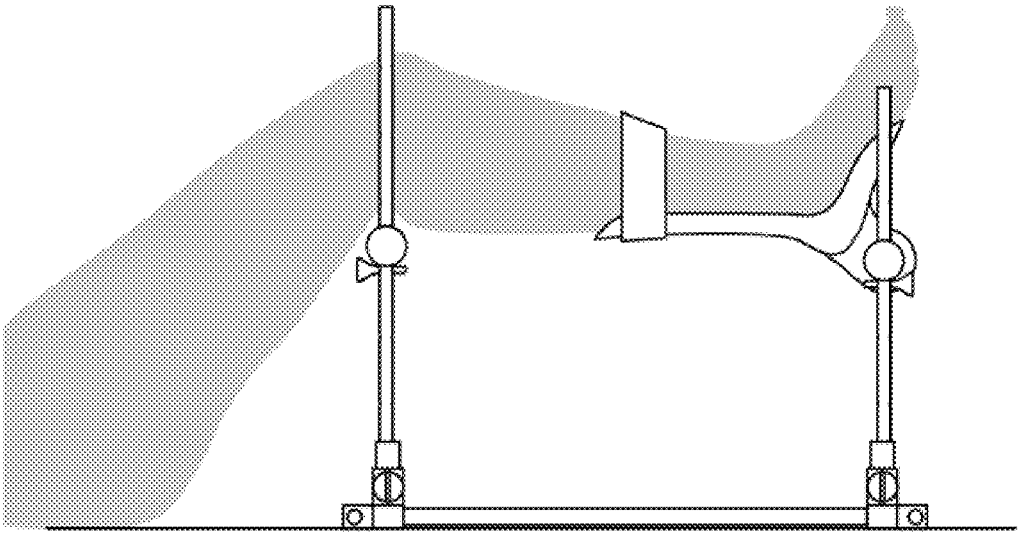
FIG. 18 is a view showing the use of a foot holder adapter with a device of the invention. The foot holder adapter can be configured to attach to either one or both raised supports (e.g., using a ring that slides along the raised support), a support bar, or both the raised supports and the support bar.
Figure 19:
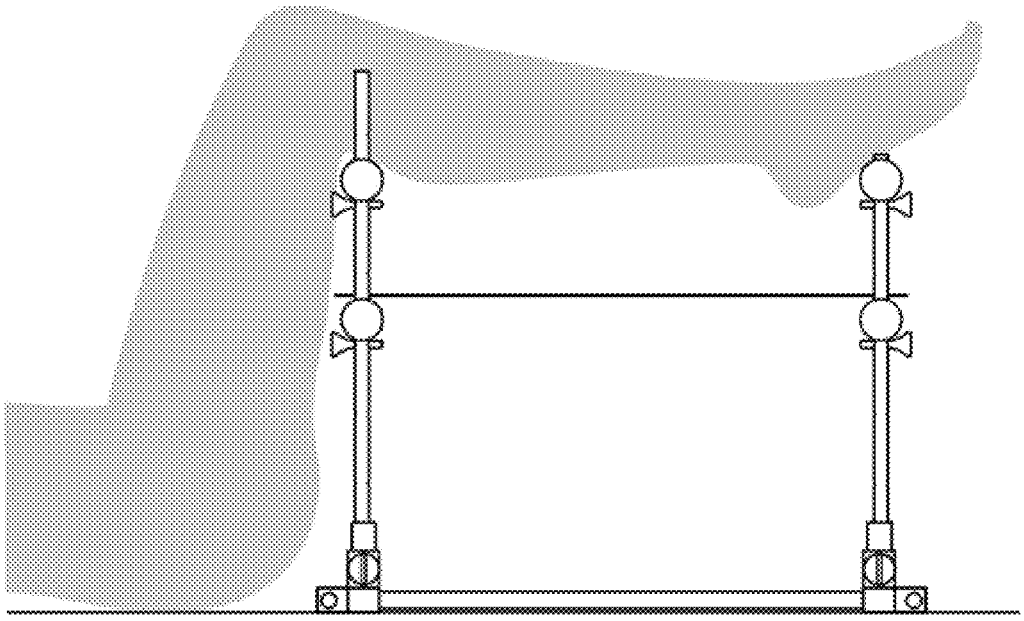
FIG. 19 is a view showing an alignment guide with a device of the invention. The guide does not make contact with the leg.

In other embodiments, the device of the invention can further include straps, wraps, or other materials for restraining and securing the limb of a patient. For example, the first and second limb support structures can include materials that assist in securing the patient's limb (e.g., an arm or leg) in place to avoid unnecessary movement during, e.g., surgery, evaluation, or rehabilitation. The patient's limb may be secured by, e.g., straps, buckles, VELCRO®, snaps, or other fasteners. The device can also include, e.g., a foot holder adapter, such as that shown in FIG. 18. The foot holder adapter can be configured with rings on either side that slide along the raised supports in order to attach the foot holder adapter to the device of the invention.

Figure 11:
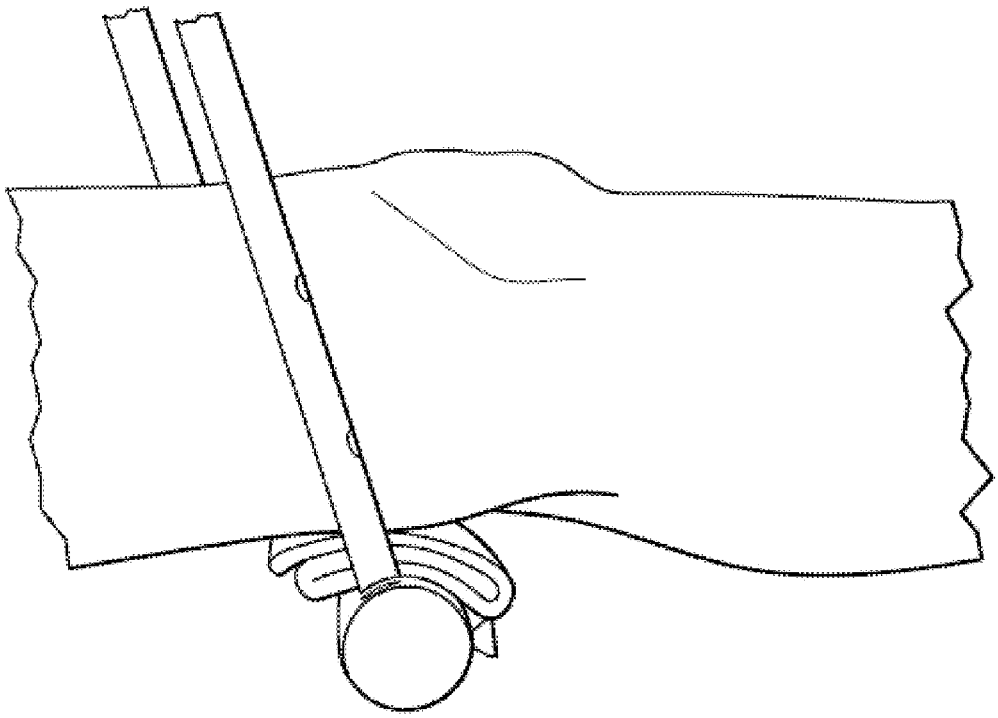
FIG. 11 is a view showing that a support bar of a device of the invention can be padded with a suitable material.

In other embodiments, components of the device of the invention (e.g., the first and second limb support bars) may include padding, foam, or other material to increase the comfort of the patient when the device is in use (see, e.g., FIG. 11).

The device of the invention can also include one or more locking supports that stabilize the device when in use and prevent excessive movement of the patient's limb during, e.g., surgery, evaluation, or rehabilitation. For example, one or more of the raised supports of the device, when placed in an upright position (e.g., an angular position in the range of about 30° to about 90° or more relative to the first and second base supports), can be secured by placing an additional locking support 11 that connects the raised support to the base support to which it is attached (see, e.g., FIG. 5) and prevents the raised support from collapsing when pressure is placed on the limb support bars by, e.g., the arm or leg of a patient. The device can include only one locking support 11 that connects one raised support to its corresponding base support, or it can include up to four locking supports (one for each raised support) that connect them to their corresponding base supports. Alternatively, one or more locking supports 13 can be used to secure the first limb support structure to the second limb support structure (e.g., connecting across raised supports). The device can also include two or more support bars attached to raised supports 32 and 34 or raised supports 62 and 64 (see, e.g., the second support bar 15 in FIG. 5).

The degrees of freedom of the various components of the positioner device of the invention, which are based, in part, upon the anatomy of the operative limb, are allowed to selectively lock and unlock to allow natural motion of the limb while still supporting the weight of the limb. Further, the present invention has been described herein with its various components. It is to be appreciated that one or more of these components can be made to be electrically controlled such that the parameters of these components (e.g., height, angle, and spacing) can be adjusted via, e.g., a control mechanism on the device or a remote control or the like.

In addition, if desired, the various components of the device can be mechanized to allow for simplified adjustment of the parameters of the components (e.g., height, angle, and spacing).

The devices of the invention may be used as surgical assist devices. For example, the patient's leg is positioned on the frame to provide a stable platform and easy access to the leg during orthopaedic procedures, e.g., procedures performed on the lower leg. These procedures include, but are not limited to care of both closed and open fractures of the lower extremity, intramedullary nailing of the tibia (peri-patellar and supra-patellar entry portal), retrograde intramedullary nailing of the femur, open reduction and internal fixation of the distal femur, open reduction and internal fixation of the proximal tibia, open reduction and internal fixation of the distal tibia, open reduction and internal fixation of the ankle, open reduction and internal fixation of the foot, application of external fixation of the lower extremity, open reduction and internal fixation of the patella, and soft tissue and ligament procedures of the knee and lower extremity.

Devices of the invention may also be used for non-orthopaedic procedures. For example, the device may be used to position the limb of a patient during vascular surgery (e.g., to remove a vein for use in cardiopulmonary bypass surgery; for use in bypass surgery associated with arteries of the leg; for use with angioplasty and stenting of vessels of the leg; for use in endarterectomy; for the treatment of peripheral artery disease (PAD); for treating limbs in need of revascularization; for treating ischemia of the extremities; or for performing amputations). Devices of the invention may also be used by a plastic surgeon to assist in the removal of skin for a skin graft or in the placement of a skin graft on the limb of a patient (e.g., a burn patient). Devices of the invention may also be used to position the limb of a patient during the treatment or repair of soft tissue, ligament, or cartilage in the extremities. Devices of the invention can also be used in reconstructive procedures on the extremity of a patient (e.g., an arm or leg). Particular uses include, e.g., osteoplasty, deformity correction, surgical treatment of osteomyelitis, and tumor surgery.

There now follows a description of particular embodiments of the invention.

Structure

Figure 2:
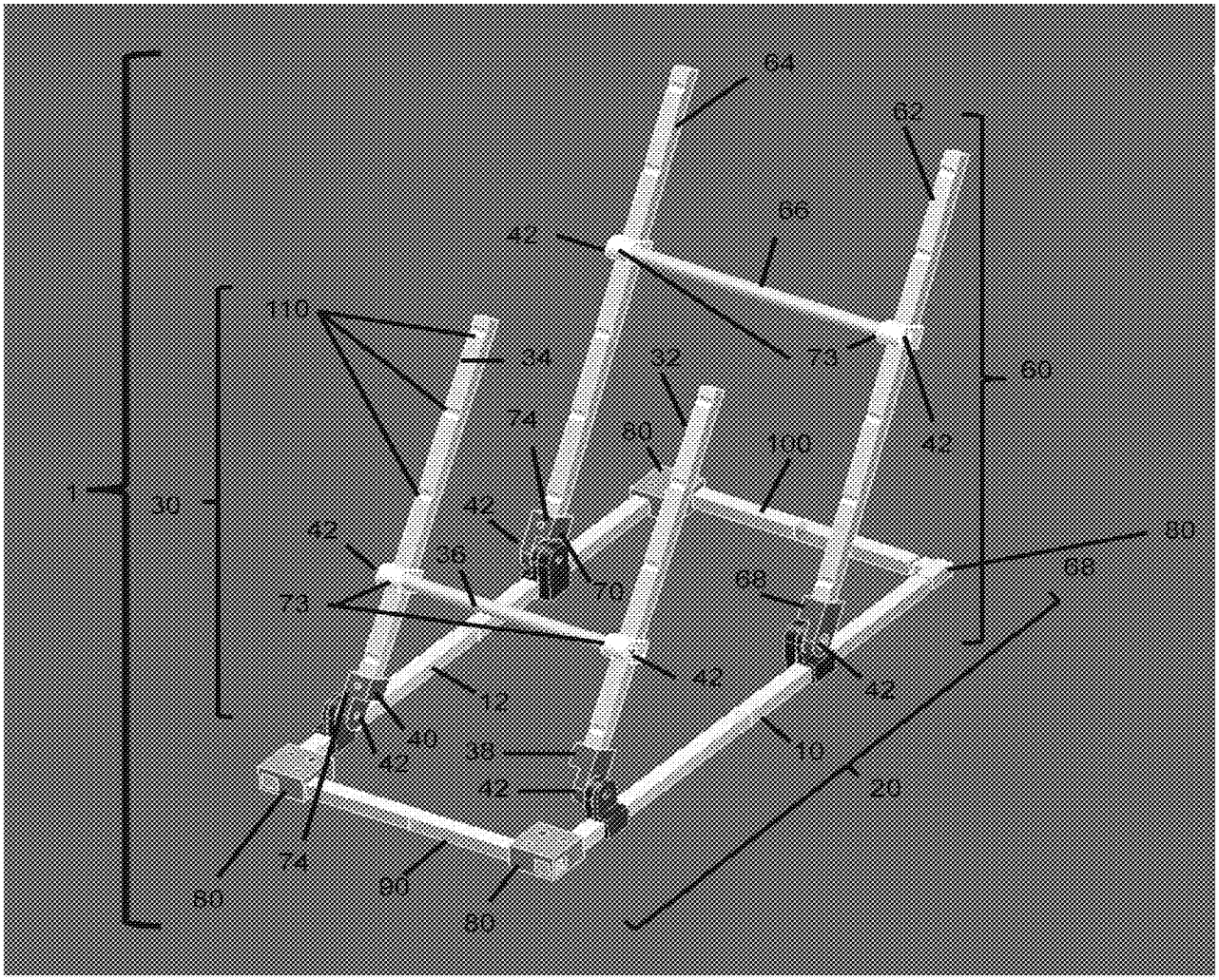
FIG. 2 is a perspective view of a device of the invention.
Figure 17:
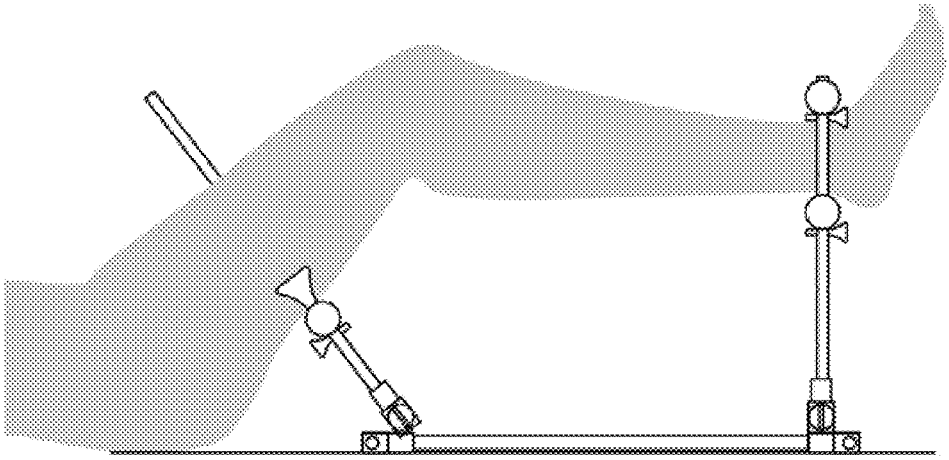
FIG. 17 is a view showing lateral femoral approach configuration of a device of the invention.
Figure 22:
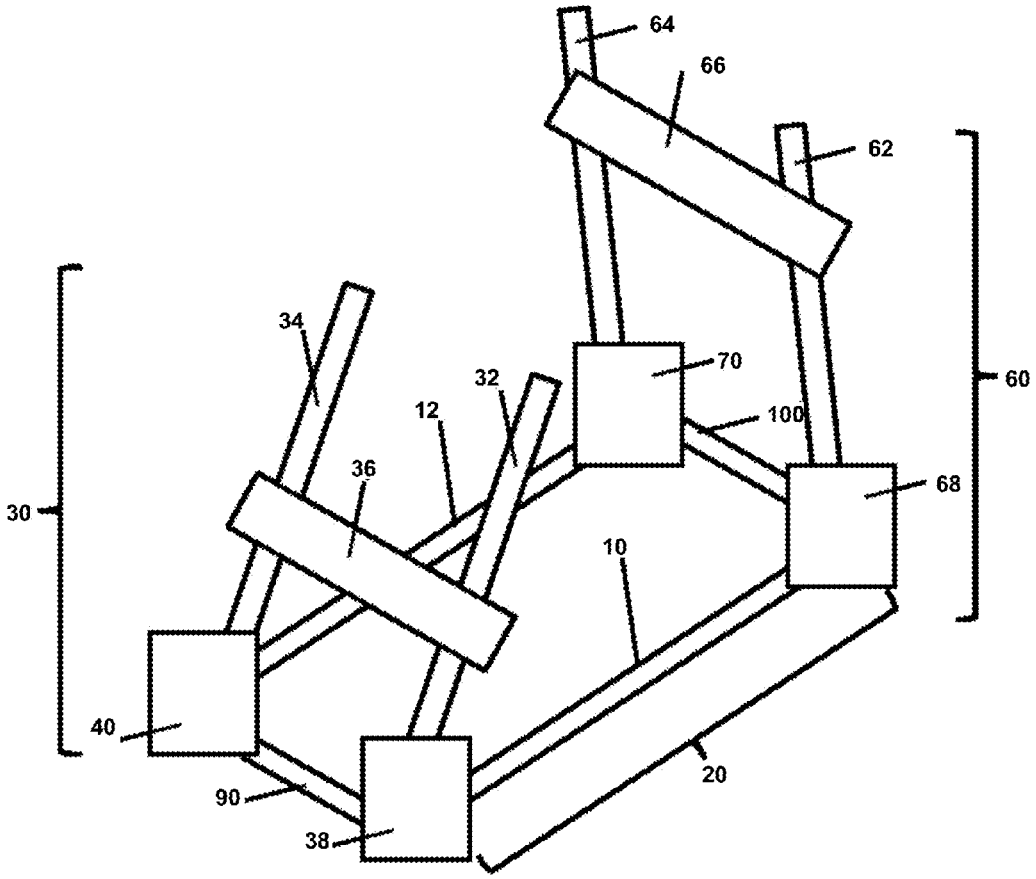
FIG. 22 is a schematic illustration of a device of the invention.

Referring to FIGS. 1, 2, and 22, positioner device 1 includes first 10 and second 12 base supports that form two opposite sides of a substantially planar base structure 20. Optionally, positioner device 1 can include third 90 and fourth 100 base supports that secure base structure 20. Positioner device 1 further includes first limb support structure 30 that includes first 32 and second 34 raised supports and first limb support bar 36. First raised support 32 includes limb support structure connector 38 that connects first raised support 32 to first base support 10. Second raised support 34 includes limb support structure connector 40 that connects second raised support 34 to second base support 12. As shown in FIGS. 1, 2, and 22 first limb support bar 36 is movably attached near its ends to first 32 and second 34 raised supports. Positioner device 1 may further include a second limb support structure 60 that includes third 62 and/or fourth 64 raised supports and second limb support bar 66. Third raised support 62 includes limb support structure connector 68 that connects third raised support 62 to first base support 10. Fourth raised support 64, if present includes limb support structure connector 70 that connects fourth raised support 64 to second base support 12. As shown in FIGS. 1, 2, and 22, first limb support bar 66 is movably attached near its ends to third 62 and fourth 64 raised supports. Shown in FIG. 17 is an embodiment of the device of the invention in which fourth raised support 64 is replaced by a tee 122 that is used to connect support bar 66 to base support 12 using limb support structure connector 70. This embodiment is referred to as a three quadrant construct (as opposed to a four quadrant construct that includes all four raised supports (32, 34, 62, and 64).

In addition, FIGS. 1 and 2 show tighteners 42 for limb support structure connectors 38, 40, 68, and 70 that secure raised supports 32, 34, 62, and 64 at an angle relative to base supports 10 and 12 (e.g., an angle in the range of about 0° to at least about 180°). For example, the angle of raised supports 32, 34, 62, and 64 can be adjusted to, e.g., 90° relative to base supports 10 and 12 by loosening tighteners 42 (e.g., wing screws) of limb support structure connectors 38, 40, 68, and 70. In another embodiment, tighteners 42 can be used not only to adjust the angle of raised supports 32, 34, 62, and 64 relative to base supports 10 and 12, but also to adjust the position of raised supports 32, 34, 62, and 64 along the length of base supports 10 and 12. For example, tighteners 42 can be loosened, which allows raised supports 32, 34, 62, and 64 to move along the length of base supports 10 and 12. Once a desired position has been established, tighteners 42 can be tightened to secure raised supports 32, 34, 62, and 64 at their new position. In another embodiment, the device can include a separate set of tighteners for adjusting the position of raised supports 32, 34, 62, and 64 along the length of base supports 10 and 12 and for adjusting the angle of raised supports 32, 34, 62, and 64 relative to base supports 10 and 12.

FIGS. 1 and 2 also show releasable connectors 80 that join base supports 10 and 12 (and base supports 80 and 100, if included in positioner device 1). Releasable connectors 80 allow for assembly and disassembly of base structure 20.

Figure 7A:
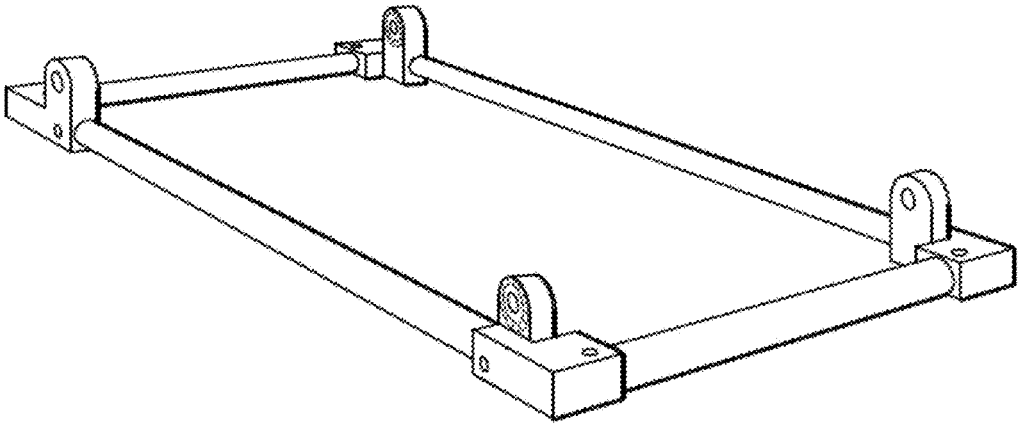
FIGS. 7A-7G show the assembly of an embodiment of a device of the invention.
Figure 7B:
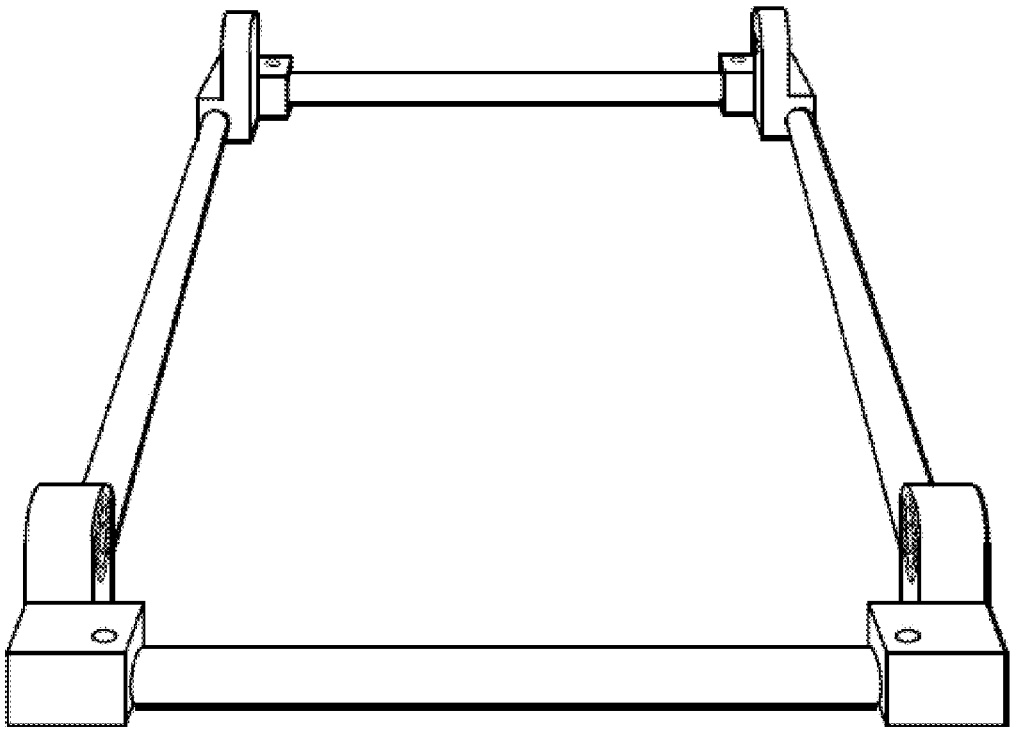
Figure 7C:
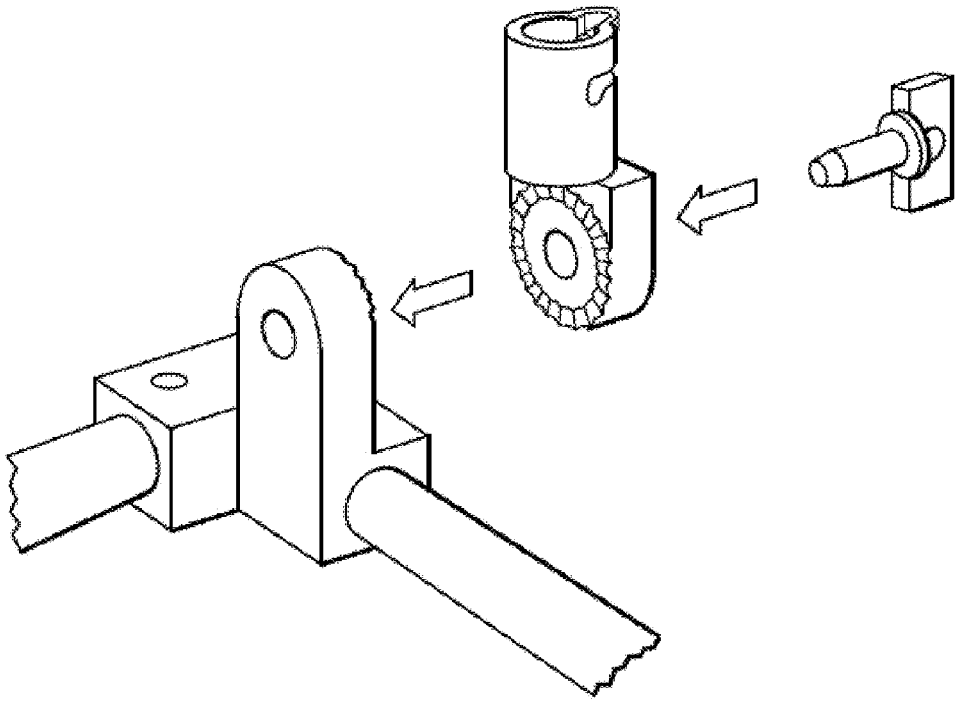
Figure 7D:
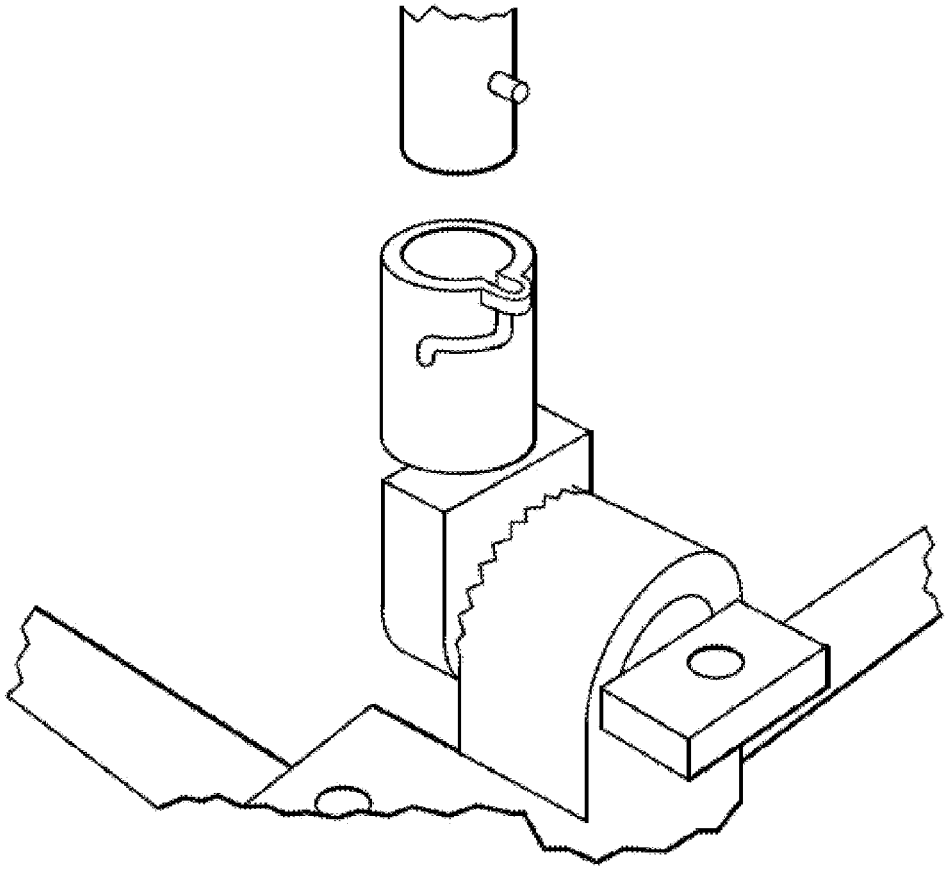
Figure 7E:
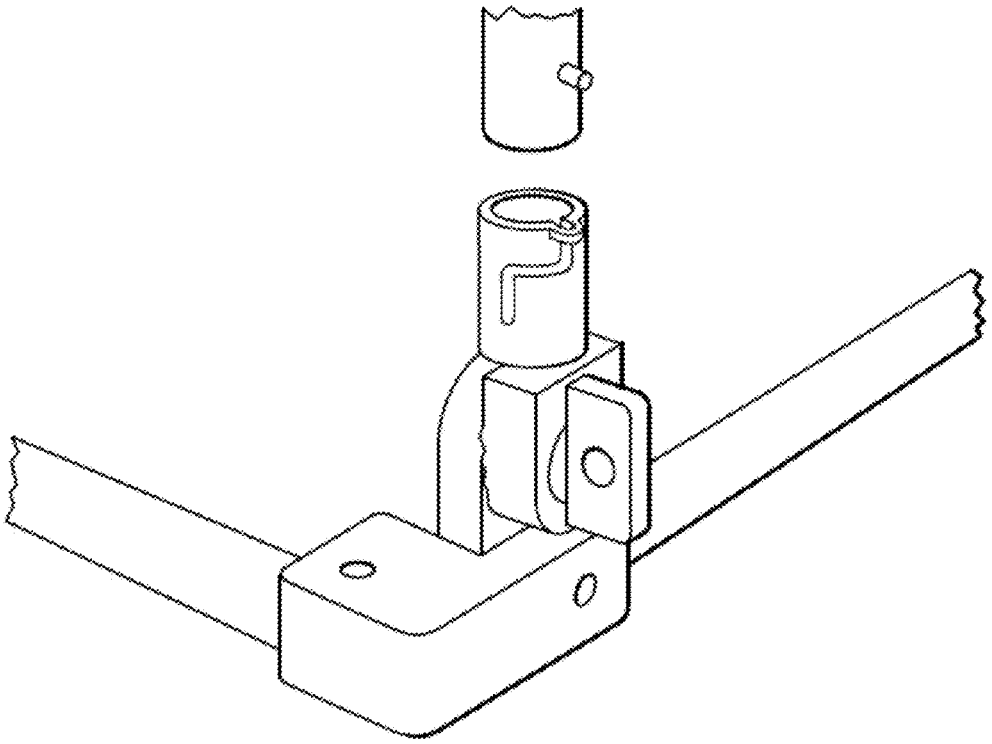
Figure 7F:
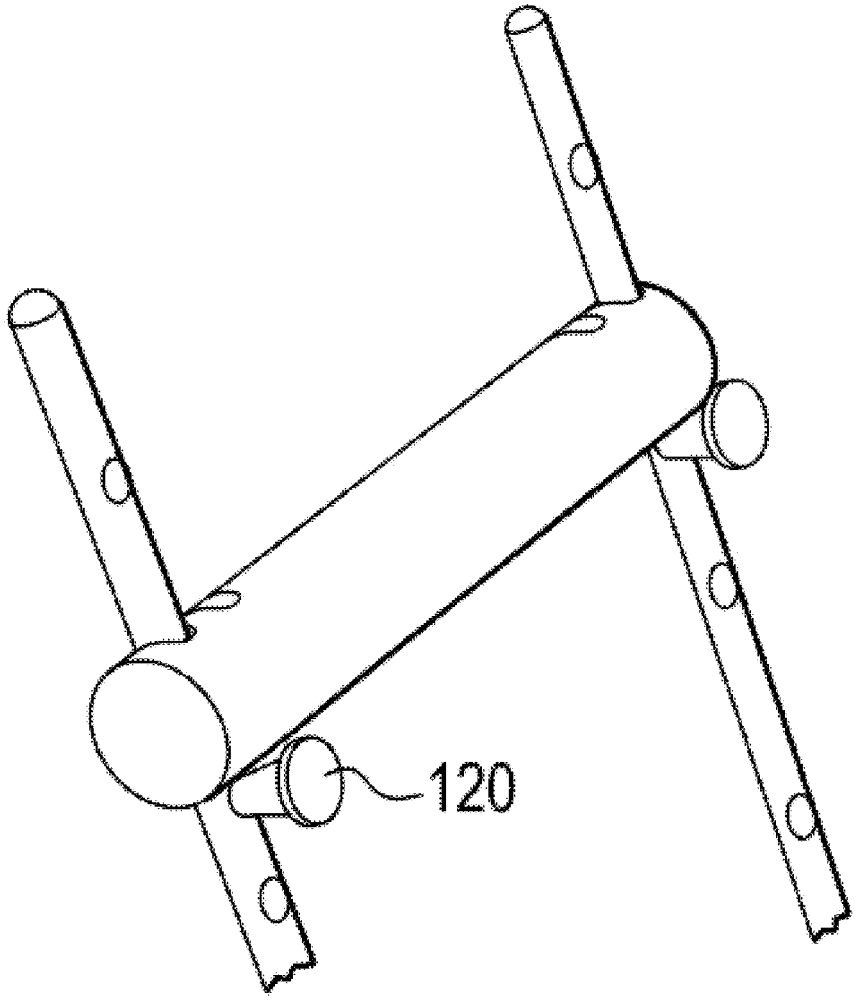
Figure 7G:
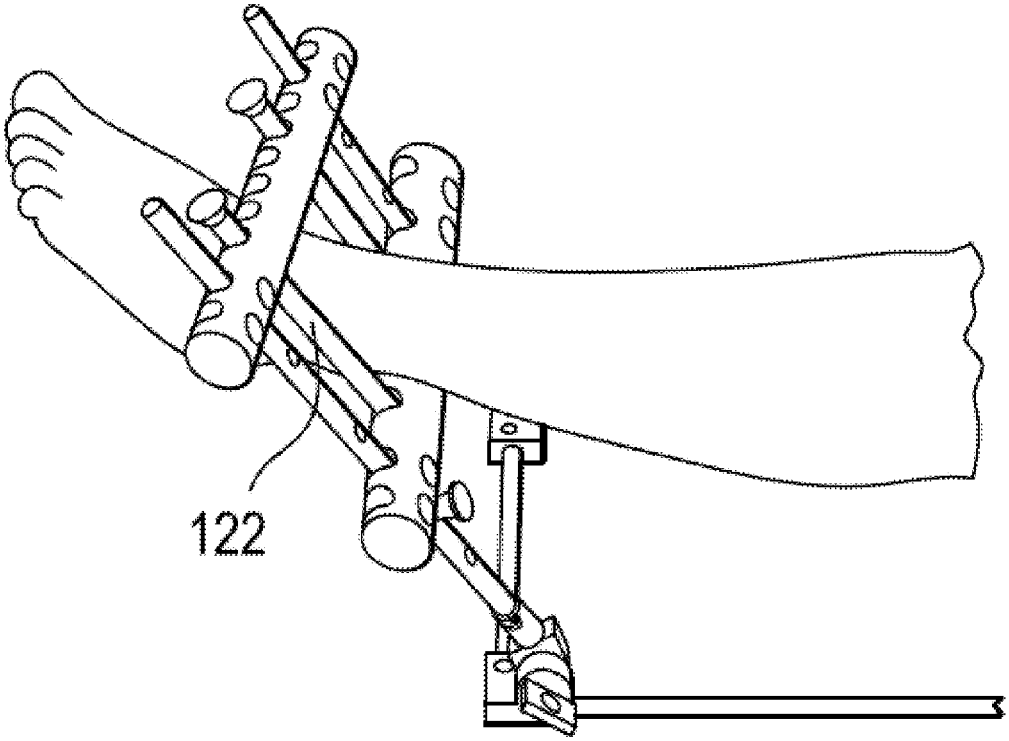

As shown in FIGS. 1, 2, and 7G, positioner device 1 further includes four locks 72 or tees 120 that secure limb support bars 36 and 66 on raised supports 32, 34, 62, and 64. Each lock 72 or tee 120 (see FIG. 7G) of raised supports 32, 34, 62, and 64 fits into one of a plurality of positioners 110, which are openings (e.g., grooves, holes, or indentations) at said pre-set locations along the raised supports. The height of limb support bar 36 or 66 can be adjusted by moving the position of lock 72 or tee 120 in raised supports 32 and 34 or in raised supports 62 and 64, respectively. For example, to raise limb support bar 36, each lock 72 or tee 120 can be removed from their original openings in raised supports 32 and 34, limb support bar 36 can be raised up above the next set of openings in raised supports 32 and 34, and each lock 72 or tee 120 can be secured in the new openings in raised supports 32 and 34 that are above the original openings. Once each lock 72 or tee 120 is secured in the new openings in raised supports 32 and 34, limb support bar 36 can be lowered so that it rests on each lock 72 or tee 120, but now at a higher position. If the height of limb support bars 36 and 66 is adjusted by moving locks 72 or tees 120, preferably each lock 72 or tee 120 is positioned so that limb support bars 36 and 66 remain level. In an alternative embodiment, limb support bars 36 and 66 can be secured to raised supports 32, 34, 62, and 64 using a limb support bar connector 73 (see FIG. 2), which can be similar to that of limb support structure connectors 38, 40, 68, and 70. In this embodiment, the height of limb support bars 36 and 66 can be adjusted up or down by simply loosing tighteners 42 associated with limb support bar connector 73, moving limb support bars 36 and 66 to a preferred height along raised supports 32, 34, 62, and 64, and tightening tighteners 42.

As shown in FIG. 1, limb support bars 36 and 66 are attached to raised supports 32 and 34 and 62 and 64, respectively, by holes that bisect the central axis of limb support bars 36 and 66. Limb support bar 36 can be secured to raised supports 32 and 34 by sliding the ends of raised supports 32 and 34 through the holes in limb support bar 36.

The same applies to limb support bar 66 which is secured to raised supports 62 and 64. In an alternative embodiment shown in FIG. 2, limb support bars 36 and 66 can be secured to raised supports 32 and 34 and 62 and 64, respectively, using a limb support bar connector 73 similar to that of limb support structure connectors 38, 40, 68, and 70. In this embodiment, limb support bars 36 and 66 can be engaged and disengaged directly from raised supports 32 and 34 and 62 and 64, respectively, without having to traverse the entire length of raised supports 32 and 34 and 62 and 64, respectively (see, e.g., FIG. 2).

Figure 5:
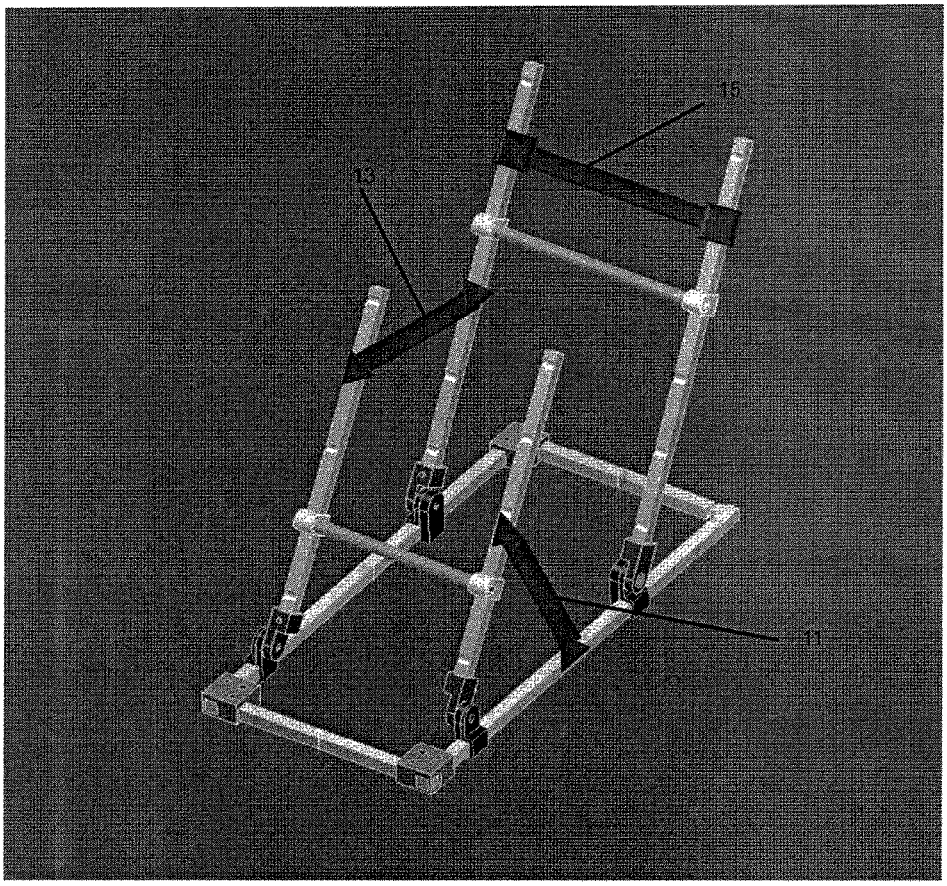
FIG. 5 is a perspective view of a device of the invention showing optional locking supports.

Referring to FIG. 5, the device of the invention can include one or more locking supports 11 that brace a raised support to a base support. The locking support can also brace a raised support from the first limb support structure to a raised support in the second limb support structure (see, e.g., 13 in FIG. 5). A second support bar can also be used to enclose a patient's limb within the limb support structure (see, e.g., support bar 15 in FIG. 5).

Operation

Figure 3:
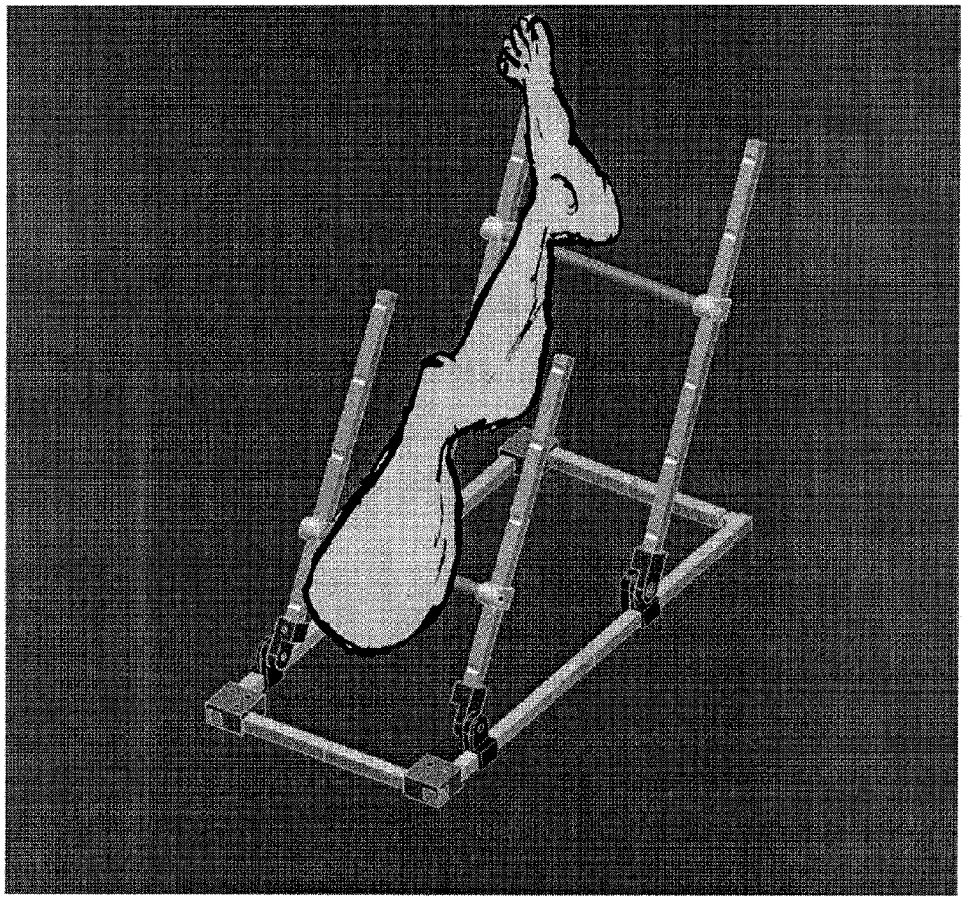
FIG. 3 is a perspective view of the device of FIG. 2 that includes a stylized picture of a patient's leg being supported by the device.

Referring to FIG. 3, positioner device 1 is shown supporting the limb (e.g., one or more legs or arms) of a human patient. Limb support bar 36 is shown supporting the portion of the leg above the knee, while limb support 66 is shown supporting the portion of the leg below the knee. In use, positioner device 1 provides easy access to the knee and surrounding portions of the leg. In particular, a surgeon or other treating physician would have 360° access to this area of a patient during, e.g., surgery, evaluation, or rehabilitation.

To adjust positioner device 1 to the leg of a patient, the height of limb support bars 36 and 66 can be individually raised or lowered by adjusting the height of each lock 72 or tee 120 in the openings of raised supports 32, 34, 62, and 64 (see, e.g., FIGS. 1 and 2). As shown in FIG. 2, the height of limb support bars 36 and 66 can be individually raised or lowered by loosening or releasing each connector 73, moving limb support bar 36 to the appropriate height for the upper portion of the patient's leg (above the knee) and moving limb support bar 66 to the appropriate height for the lower portion of the patient's leg (below the knee), and tightening or refastening each connector 73 to raised supports 32, 34, 62, and 64.

Positioner device 1 can also be adjusted to comfortably position and support the limb of a patient by increasing or decreasing the distance of first limb support structure 30 relative to second limb support structure 60. For example, as shown in FIG. 1, first limb support structure 30 is positioned at its maximum distance from second limb support structure 60. First limb support structure 30 can be positioned closer to second limb support structure 60 by loosening limb support structure connectors 38 and 40 and sliding first limb support structure 30 along base supports 10 and 12 towards second limb support structure 60. Once an appropriate distance has been achieved to comfortably position the leg of a patient, movable and releasable connectors 38 and 40 can be retightened.

Another adjustment that can be made to comfortably position and support the limb of a patient is to alter the angle of the first 30 or second 60 limb support structures relative to base supports 10 and 12. For example, as shown in FIG. 1, first limb support structure 30 is positioned at an angle of approximately 80° relative to base supports 10 and 12. The angle of first limb support structure 30 can be increased (e.g., to 180° or any angles between 80° and 180° relative to base supports 10 and 12) or decreased (e.g., to 0° or any angles between 80° and 0° relative to base supports 10 and 12) by loosening limb support structure connectors 38 and 40 and increasing or decreasing the angle of first limb support structure 30 to the achieve an angle that comfortably positions and supports the limb of a patient. Once an appropriate angle has been achieved to comfortably position the leg of a patient, limb support structure connectors 38 and 40 can be retightened. Similarly, FIG. 1 shows second limb support structure 60 positioned at an angle of approximately 80° relative to base supports 10 and 12. The angle of second limb support structure 60 can be increased (e.g., to 180° or any angles between 80° and 180° relative to base supports 10 and 12) or decreased (e.g., to 0° or any angles between 80° and 0° relative to base supports 10 and 12) by loosening limb support structure connectors 68 and 70 and increasing or decreasing the angle of first limb support structure 60 to the achieve an angle that comfortably positions and supports the limb of a patient. Once an appropriate angle has been achieved to comfortably position the leg of a patient, limb support structure connectors 68 and 70 can be retightened.

In an embodiment, raised supports 32, 34, 62, and 64 of positioner device 1 can include telescoping ends that can extend and retract (see, e.g., FIG. 22). Optionally, raised supports 32, 34, 62, and 64 can retract to a length of 10 cm and can be extended to a length of 100 cm or more. Raised supports 32, 34, 62, and 64 can be secured in their extended or retracted state by pins, fasteners, clamps, or other mechanisms (see, e.g., the telescoping rod assembly described in, e.g., U.S. Pat. No. 5,330,061). Raised supports can also be secured in their connectors by locking member 74 (e.g., pins, fasteners, clamps, or other mechanisms).

Figure 4A:
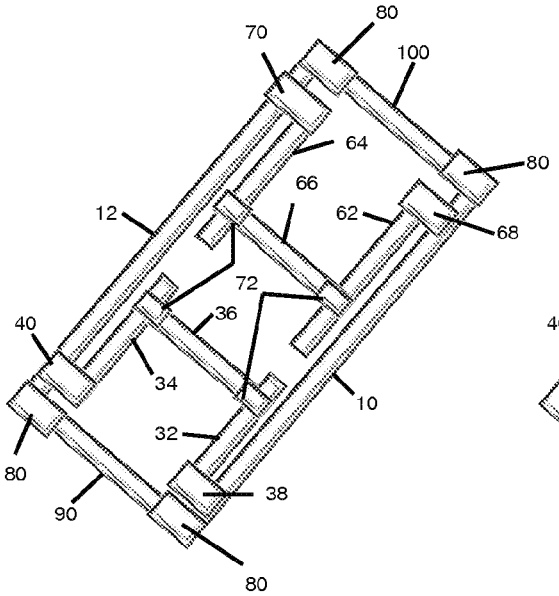
FIGS. 4A and 4B show a perspective view of a device of the invention in collapsed form with (FIG. 4A) and without (FIG. 4B) third and fourth base supports.
Figure 4B:
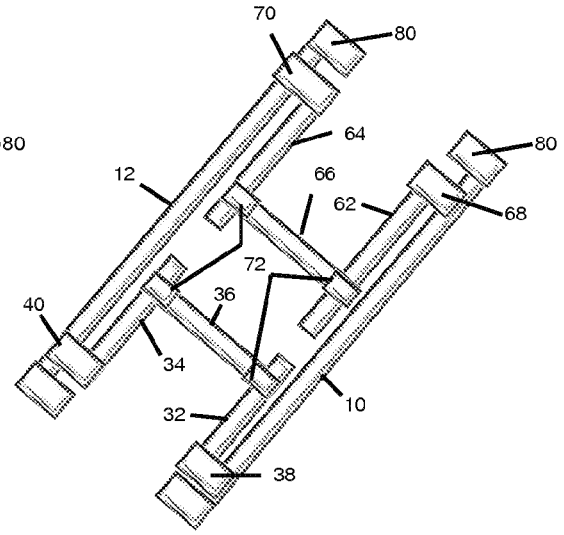

When not in use, limb support structure connectors 38, 40, 68, and 70 can be loosened, allowing first limb support structure 30 and second limb support structure 60 to be flattened by positioning them into the center of base structure 20 (e.g., the angles of first 30 and second 60 limb support structures can be decreased to, e.g., ~0° (e.g., between 0 and 10°), relative to base supports 10 and 12) to form a compact structure (see, e.g., FIGS. 4(*a*) and 4(*b*)). This compact structure facilitates storage and transport of positioner device 1. In addition, positioner device 1, once placed into this compact structure, can be sterilized by placement in an autoclave or by other methods (e.g., by radiation, chemicals, heat, or high pressure). Once sterilized, positioner device 1 can be placed into a contamination-free sealed material and stored until ready for use.

Figure 6:
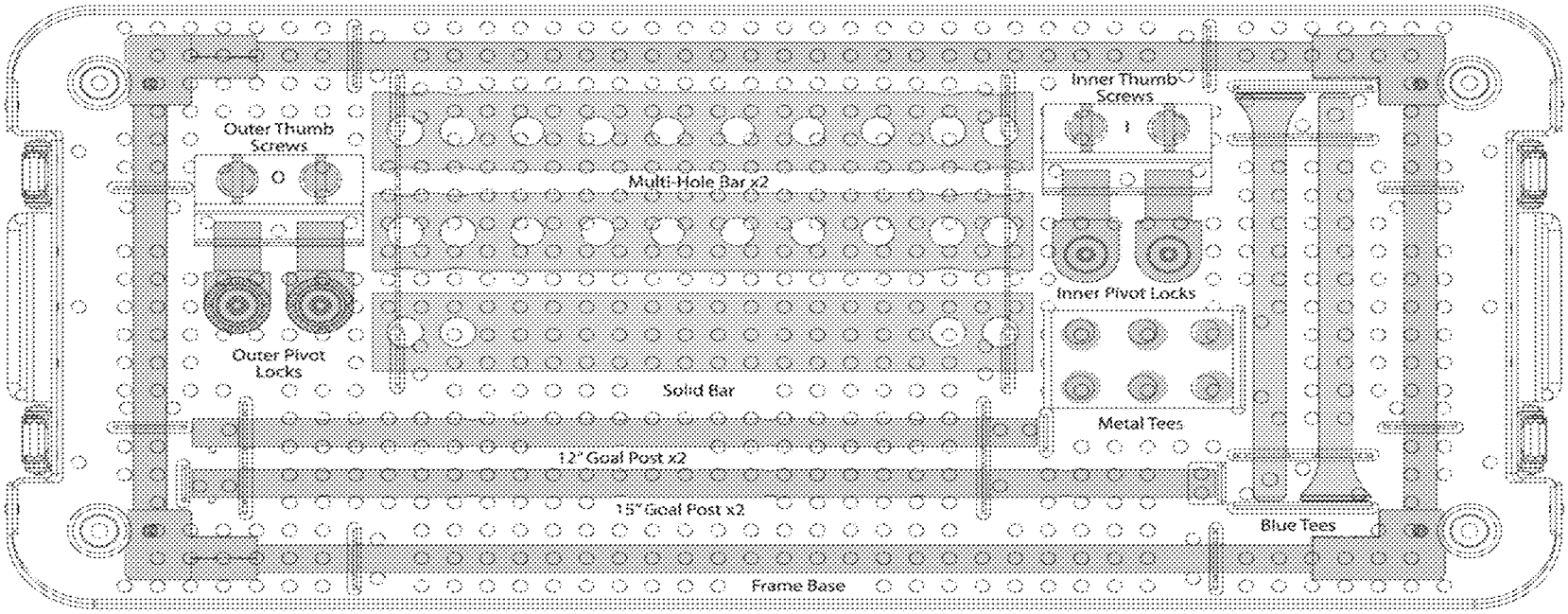
FIG. 6 is a perspective view of the packaging of a device of the invention in its unassembled form. The device may be packaged in a tray (e.g., a sterilization tray) that is designed for easy access to, and identification of, all components of the device.

Alternatively, the device can be disassembled and subjected to cleaning and sterilization before or after use (see, e.g., FIG. 6). Base structure 20 of positioner device 1 can also be disassembled by disconnecting releasable connectors 80, which separates base supports 10, 12, 90, and 100 from each other. Raised supports 32, 34, 62, and 64 can also be disassembled from base supports 10 and 12 by loosening limb support structure connectors 38 and 40 and 68 and 70, respectively. In addition, limb support bars 36 and 66 can be separated from raised supports 32 and 34 and 62 and 64, respectively, by loosening the connector securing limb support bars 36 and 66 to raised supports 32 and 34 and 62 and 64, respectively, if present, and separating limb support bars 36 and 66 from to raised supports 32 and 34 and 62 and 64, respectively, or lifting limb support bars 36 and 66 above and away from raised supports 32 and 34 and 62 and 64, respectively. Once disassembled, positioner device 1 can be sterilized by placement in an autoclave or by other methods (e.g., by radiation, chemicals, heat, or high pressure). Once sterilized, the disassembled parts of positioner device 1 can be placed into a contamination-free sealed material and stored until ready for use.

Figure 9:
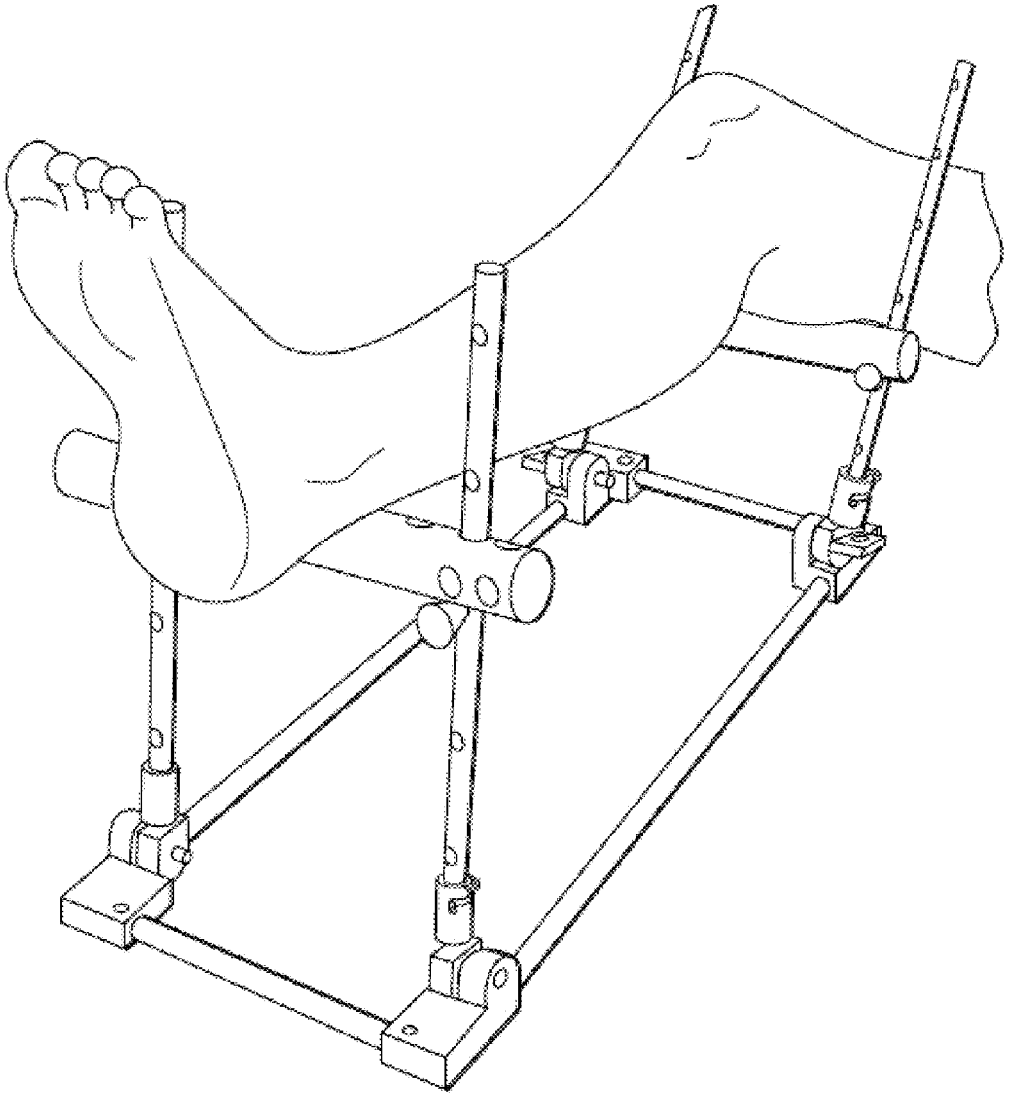
FIG. 9 is a perspective view showing adjustment of a device of the invention to position the lower extremity of a patient in a semi-extended position.
Figure 10:
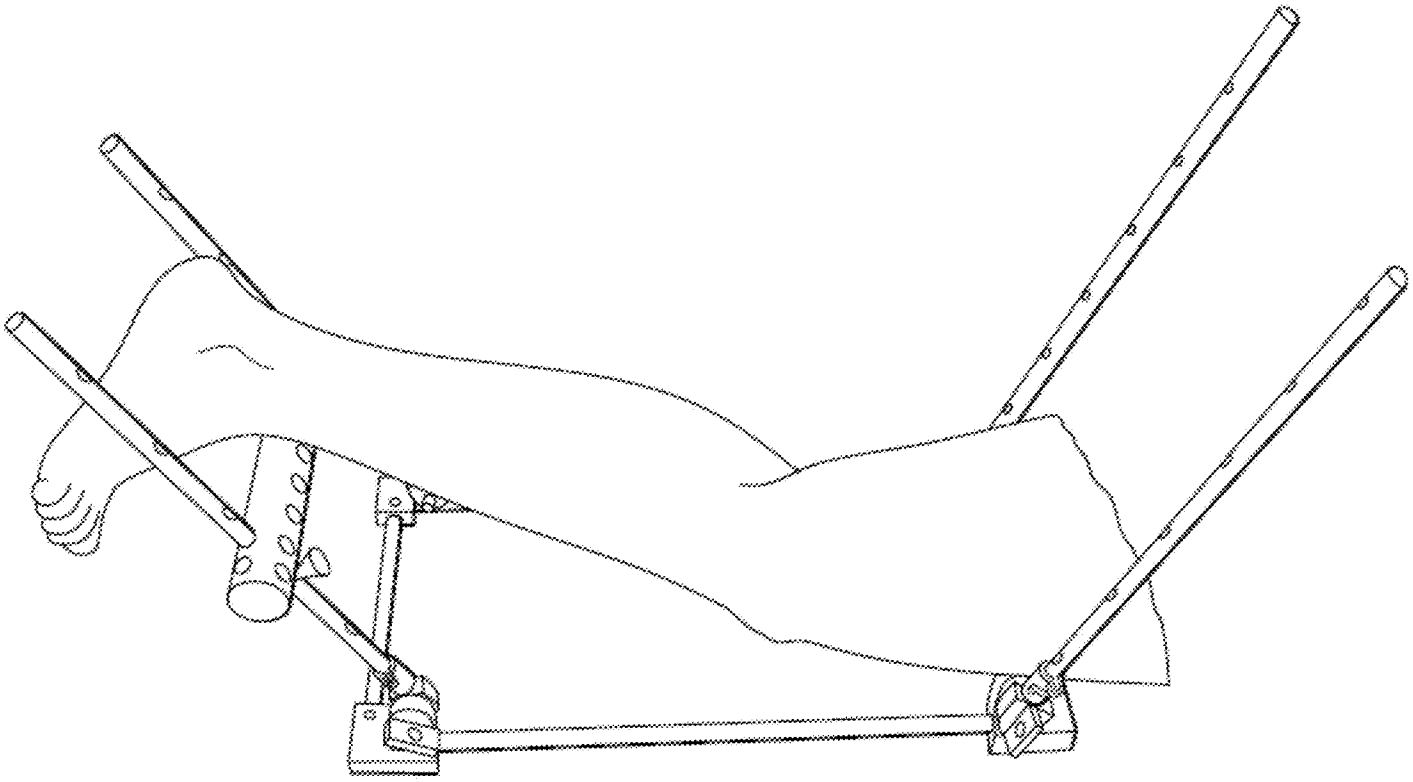
FIG. 10 is a perspective view showing adjustment of a device of the invention to position the lower extremity of a patient in a prone position.

The device can be packaged in an unassembled form (see FIG. 6) and quickly assembled prior to use (e.g., during the standard or set-up time prior to surgery). During assembly, one can grasp support bars 36 and 66, once secured, to stabilize raised supports 32 and 34 and 62 and 64, respectively, while the angle of raised supports 32 and 34 and 62 and 64 is being adjusted. For example, one can hold support bar 66 with one hand, loosen each tightener 42 (e.g., thumb screws) at least one turn, adjust the angle of raised supports 62 and 64 to the desired angle, and retighten each tightener 42. As shown in FIG. 7F, support bars 36 and 66 can be secured at their desired heights by resting on metal tees 120, which lock into place by the weight of the patient's leg. To prevent metal tees 120 from loosening without the weight of the leg, tees 120 may be placed on the inside slope of the angle (as shown in FIG. 7F). Once assembled, the device can be placed under the patient's leg and further adjusted, if necessary, to the desired angle and height (FIGS. 9 and 10).

The device of the invention allows for excellent access to the patient's leg for, e.g., debridement and irrigation of open fractures or irrigation and closure of a surgical wound in the patient's leg. In addition, placement of a wound vacuum assisted closure (VAC) device is simplified by 360° access to the lower extremity (see FIG. 15).

In an embodiment, support bar 36 or 66 can be padded with a towel, cast padding, soft cushion, or other suitable material (preferably the material is sterile; see FIG. 11).

Figure 12:
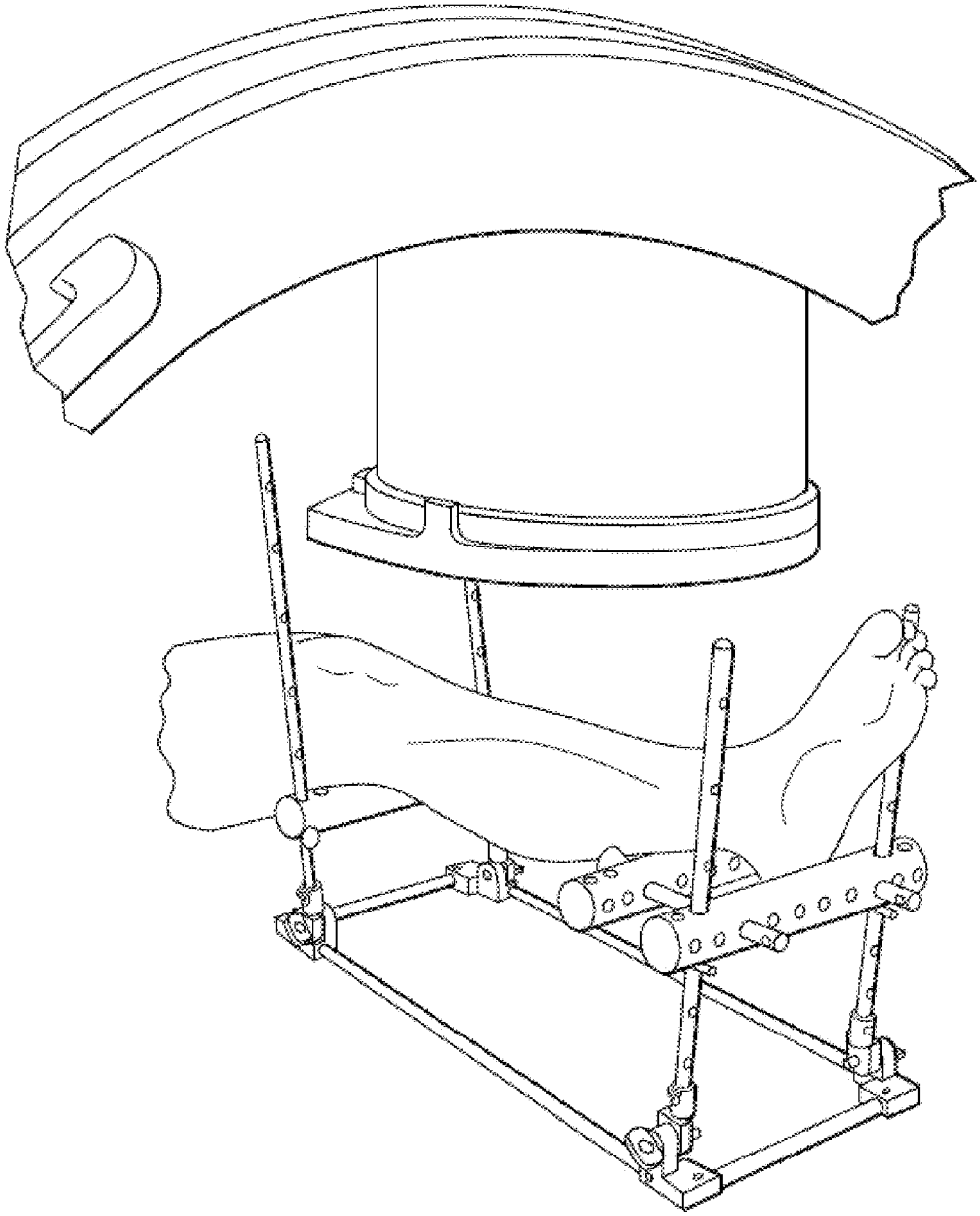
FIG. 12 is a view showing anterior to posterior (AP) access of an X-ray machine to the limb of a patient that is supported by a device of the invention.
Figure 13:
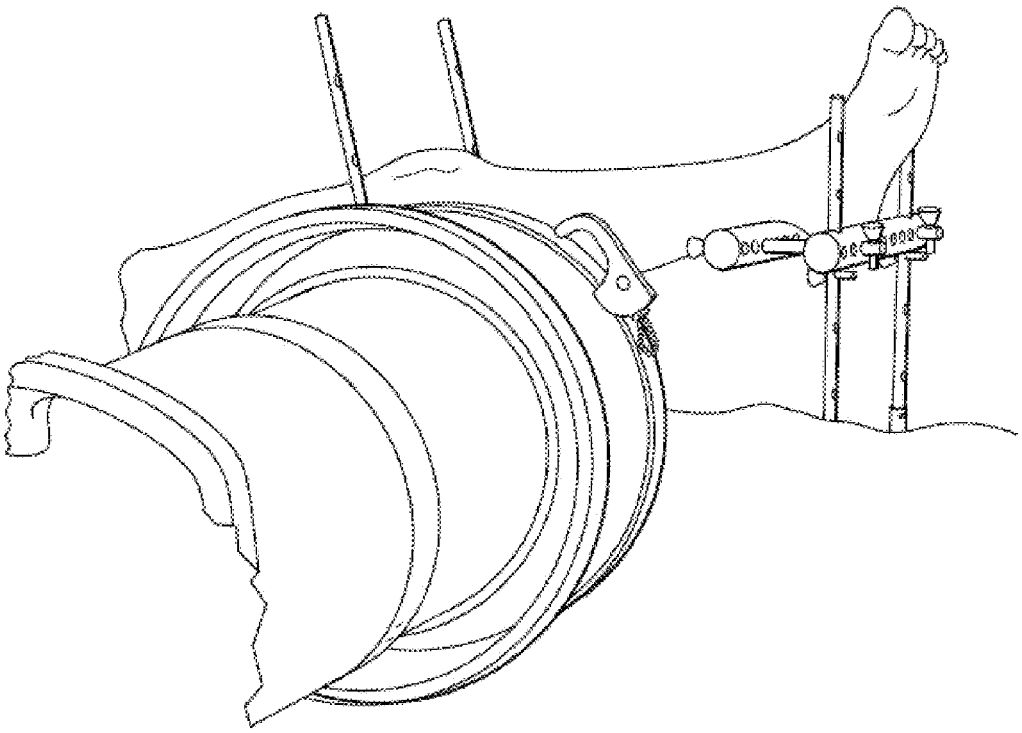
FIG. 13 is a view showing lateral access of an of an X-ray machine to the limb of a patient that is supported by a device of the invention.

The device of the invention is compatible with, and can be used during, computer-assisted surgery using either electromagnetic or infrared sources of sensor positioning requiring nonmagnetic support structures for the limb and surgical field during surgery, x-ray imaging or x-ray guided surgery, and/or magnetic resonance imaging (MRI) in order to assist in surgery or to assess a patient's extremity. For example, as shown in FIGS. 12 and 13, the device can be adjusted to place a patient's leg in a stable position and an X-ray device can be easily adjusted to simply roll back and forth from AP to lateral.

Figure 14:
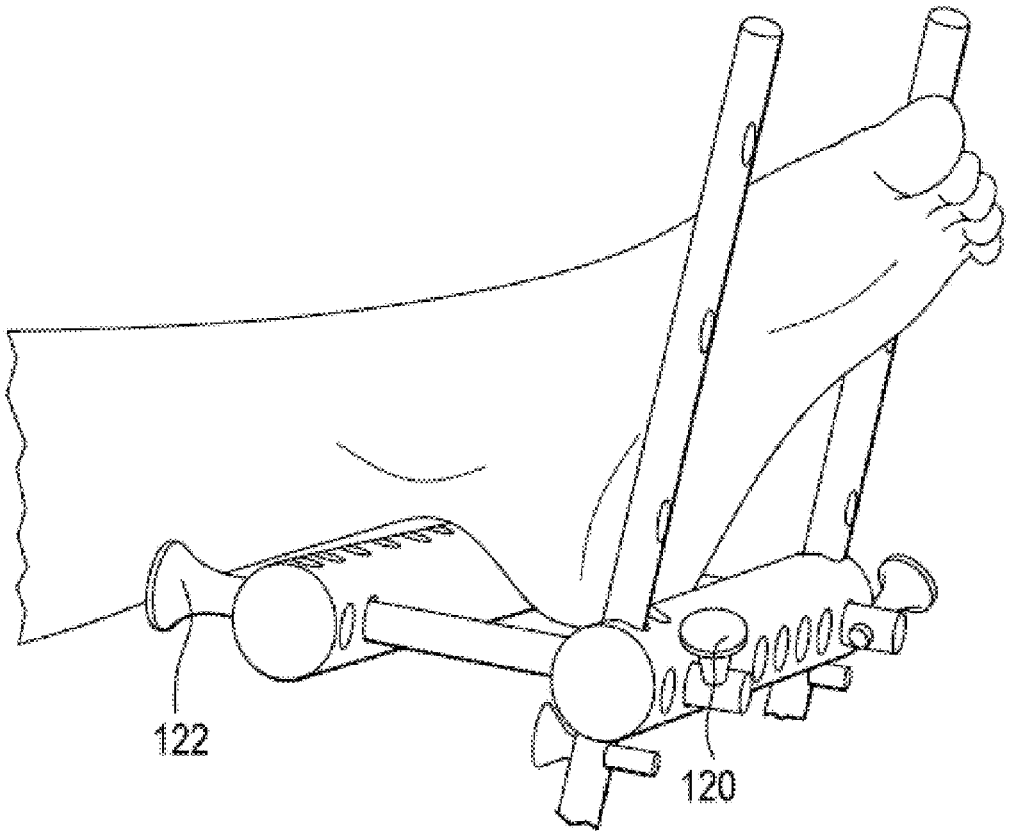
FIG. 14 is a view showing a device of the invention that has been configured to hold a retractor using a metal tee 120. Also shown is the use of a hemostat attached to COBAN™ wrap and hooked to raised supports of a device of the invention in order to hold a patient's foot in internal rotation. In addition, as shown in FIG. 14, tees 122 can be locked into place with the smaller metal tees 120.

The device of the invention can also provide hands-free support of the lower extremity. As shown in FIG. 14, the device can assist in holding a retractor or it can hold a patient's foot in internal rotation by utilizing, e.g., a hemostat attached to COBAN™ wrap and hooked to the frame of the device. In addition, as shown in FIG. 14, tees 122 can be locked into place with the smaller metal tees 120.

Figure 15:
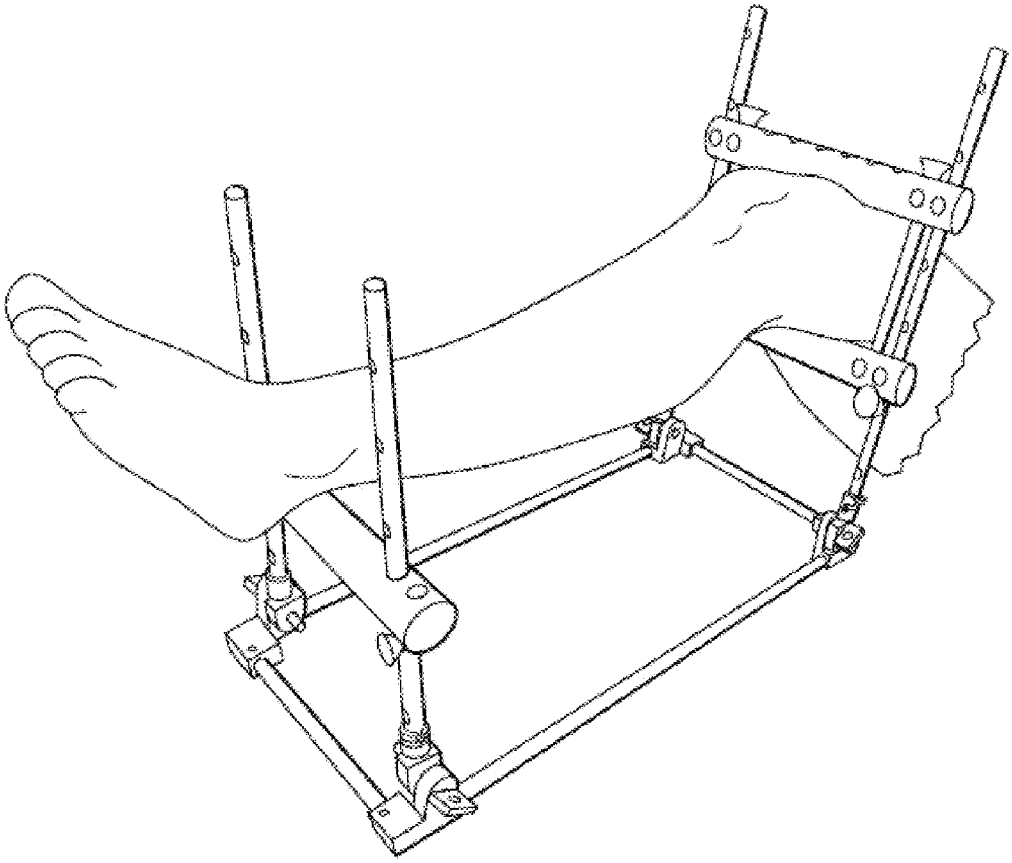
FIG. 15 is a view showing a device of the invention that has been configured to lock the femur of a patient into place to assist in fracture reduction.

The device of the invention can also be configured to assist in fracture reduction. As shown in FIG. 15, the device of the invention can be configured to lock the femur into place. In this example, the support bar in this position helps reduce a distal femur fracture where the distal femur sags posteriorly.

Figure 16:
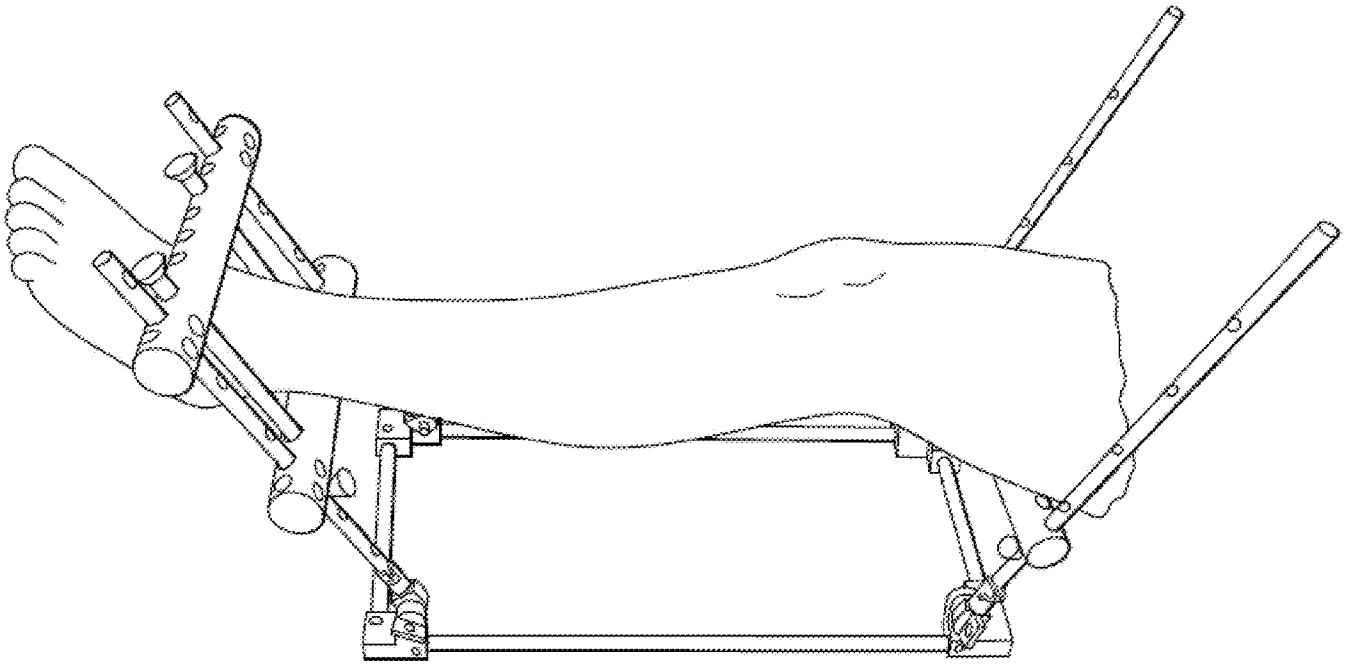
FIG. 16 is a view showing a device of the invention that has been configured to lock the ankle of a patient into place using a second support bar 36 secured to a first support bar 36 using tees 122.

In another embodiment, the device of the invention can be configured to lock the ankle into place using a second support bar 36 secured to a first support bar 36 with tees 122 (see FIG. 16). This configuration of the device locks the rotation and provides a slight amount of traction, which helps in fracture reduction.

EXAMPLES

The following examples are to illustrate the invention. They are not meant to limit the invention in any way.

Example 1: Use of a Positioner Device of the Invention to Repair a Fracture or Other Bone or Tissue Defect A positioner device of the invention can be used to provide fracture support, e.g., for a subarticular fracture, in conjunction with conventional fixation. The positioner allows for the extremity to be placed at different angles and heights creating an optimal workspace for fixation. The positioner allows for proper alignment of a fracture prior to fixation. The positioner also allows for greater access to a patient's extremity during fixation (e.g., the positioner does not obstruct the physician's access to the extremity during bone or fracture repair procedures).

Example 2: Use of a Positioner of the Invention in Conjunction with Reattachment of Ligaments or Tendons A positioner of the invention can be used to provide support and proper positioning of the limb of a patient during surgery to reattach a torn ligament or tendon. The positioner can be used to adjust the height of the patient's limb to provide easy access for the surgeon to the area in need of attention. The positioner can also be used to place the limb in a comfortable position for the patient.

Example 3: Use of a Positioner of the Invention for Anterior Cruciate Ligament (ACL) Reconstruction A positioner of the present invention can be used to position and support a patient's leg so that the patient's knee is easily accessible to the surgeon during surgery on, or replacement of, the ACL following a tear.

Example 4: Use of a Positioner of the Invention for Evaluation or Rehabilitation A positioner of the present invention can be used to provide support and proper positioning to the limb of a patient to allow a treating physician to evaluate the limb. For example, the positioner allows the limb to be placed without obstruction of the knee or elbow, thereby providing the treating physician with full and unobstructed access during evaluation of the limb for damage or to determine whether surgical intervention is warranted.

The positioner can also be used to properly support and position a patient's limb during rehabilitation (e.g., post-surgery or injury). The positioner device provides several degrees of freedom for adjustment, which assures that the device can be adjusted to achieve the proper posture for the patient.

Example 5: Device Assembly

FIGS. 7A-G show the assembly of an embodiment of the device of the invention. FIG. 7A shows placement of the frame base flat on the sterile table. FIG. 7B shows that there are pivots on one end of the frame base that are attached on the inside (i.e., inner pivots) and on the opposite end attached on the outside (i.e., outside pivots). The end where the pivot locks attach on the outside may be wider to accommodate the thigh more easily. FIG. 7C shows the attachment of a pivot lock with a corresponding thumb screw. FIG. 7D shows the sliding of a structural post into the pivot lock attached on one of the inner pivots. As shown, the structural posts are secured by twisting them into place to lock. FIG. 7E shows the sliding of a structural post into the pivot lock attached on one of the outer pivots, which also twists into place to lock. FIG. 7F shows the placement of the solid support bar (shown with four holes) along the structural posts. It is secured at the desired level with metal tees on the femoral side. Finally, FIG. 7G shows the use of a second solid support bar to support and secure the foot and ankle of a patient while using the device. The foot and ankle can be locked into place by sliding a second multi-hole support bar over the ankle and locking together with elongated tees 122 secured by another set of metal tees 120.

Example 6: Use of the Device to Position a Patient in a Hyper-Flexed Position

Figure 8:
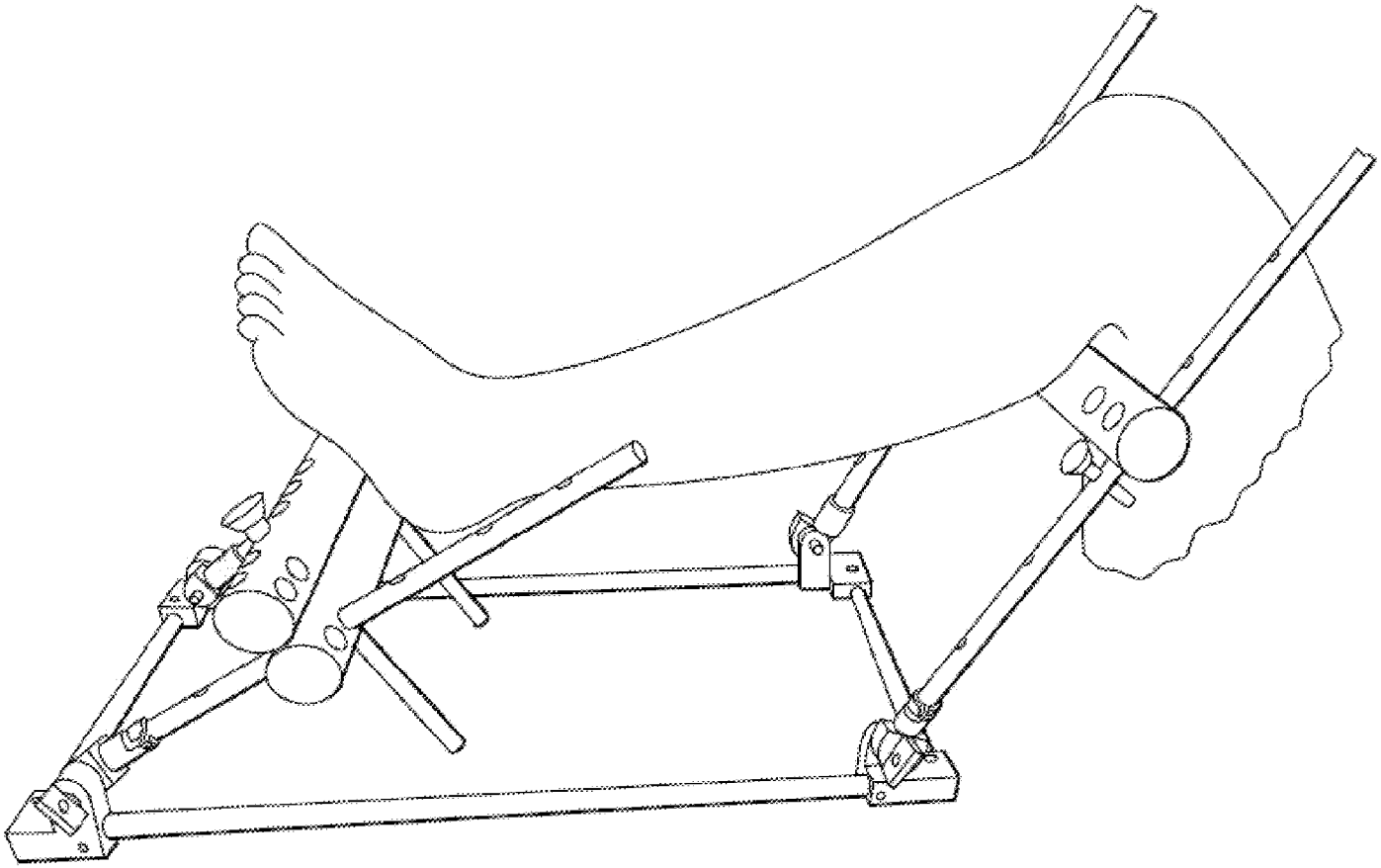
FIG. 8 is a perspective view showing adjustment of a device of the invention to position the lower extremity of a patient in a hyper-flexed position.

The device of the invention can be adjusted in order to position the lower extremity of a patient in a hyper-flexed position. This is shown in FIG. 8. A surgeon may wish to position the lower extremity of a patient in a hyper-flexed position in order to perform standard nailing of the tibia, for soft tissue and ligament reconstruction around the knee, or for arthroscopically-assisted knee surgery.

In order to position the lower extremity of a patient in a hyper-flexed position using the device of the invention, the positioner can place the femoral support posts (raised supports 62 and 64 of, e.g., FIG. 1) at the appropriate angle and height for the size of the patient and the desired amount of hyper-flexion and the extremity can rest on solid support bar 66. The foot can be rested on the table for full flexion or one can attach, e.g., two multi-holed limb support bars 36 to raised supports 32 and 34, as shown in FIG. 8, to provide a footrest.

Example 7: Use of the Device to Position a Patient in a Semi-Extended Position

The device of the invention can be adjusted in order to position the lower extremity of a patient in a semi-extended position. This is shown in FIG. 9. The semi-extended position is a common position and can be used for a number of different surgeries that may include, e.g., supra-patella tibial nailing, retrograde femoral nailing, open reduction and internal fixation (ORIF) of the distal femur, ORIF of the proximal tibia, debridement and irrigation of the lower extremity, fasciotomy, and external fixation.

In order to position the lower extremity of a patient in a semi-extended position using the device of the invention, the positioner can place the femoral raised supports 62 and 64 at approximately 30° cephalad with solid support bar 36 attached midway (see FIG. 9). Support bar 36 may be locked at the desired height with metal tees. Raised supports 32 and 34 can be adjusted to the desired angle and support bar 36 can be raised to the appropriate height in order to keep the tibia parallel to the floor.

Example 8: Use of the Device to Position a Patient in a Prone Position

The device of the invention can be adjusted in order to position the lower extremity of a patient in a prone position. This is shown in FIG. 10. The prone position is useful for several procedures, including the posterior approach to the knee and lower extremity and ORIF of the distal tibia and ankle when a posterior approach is necessary. In the prone position, the solid support bar 66 can be removed completely or placed on the lowest level. Raised supports 32 and 34 can be placed at approximately 30° caudad and solid support bar 36 can be placed at the desired height and secured with lock 72 or tee 120.

Example 9: Cleaning of the Device of the Invention

The device of the invention should be thoroughly cleaned prior to its use in a medical or surgical context. Decontamination and disinfection of the device can occur, e.g., after completion of a surgical procedure, according to standard medical protocols.

Example 10: Sterilization of the Device of the Invention

The device of the invention should be sterilized before its use in a medical or surgical procedure. Sterilization may be performed prior to surgery using, e.g., one of the following methods:

1. Flash Sterilization—unwrapped: Temp 270° F. (132° C.) at 27 psi for 10 minutes with 1 minute dry time.

2. Gravity Sterilization—wrapped in two layers of 1-ply polypropylene wrap using sequential wrapping techniques with a surgical towel placed between the wraps and the bottom of the tray. Temp 270° F. (132° C.) for 15 minutes with 30 minutes dry time. The device can be placed into a sterilization tray (see, e.g., FIG. 6) for sterilization and cleaning.

All publications, patents, and patent applications mentioned in the above specification are hereby incorporated by reference, including U.S. Patent Application No. 61/311,849. Various modifications and variations of the described method and system of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention that are obvious to those skilled in the art are intended to be within the scope of the invention.

Other embodiments are in the claims.

The invention claimed is:

1. A system for a limb positioning device, comprising:

four base supports and four base support connectors, wherein each of the base support connectors is configured to join one end of each of two base supports, thereby forming a base structure substantially in the form of a parallelogram;

four raised supports;

two or more support structure connectors, each of which is configured for movable translation along a length of one of said base supports and for rotatable connection of one of said raised supports to one of said base supports;

two or more limb support bars, including a first limb support bar configured to extend between a first pair of the four raised supports and a second limb support bar configured to extend between a second pair of the four raised supports in a direction parallel to the first limb support bar, wherein a distance between the first and second limb support bars is adjustable as a result of the translation and rotation provided by the two or more support structure connectors; and one or more limb support bar connectors that are configured for releasable engagement to said raised supports such that, when one of said limb support bar connectors is engaged to one of said raised supports, said limb support bar connector provides support for one of said limb support bars at or near one end of the limb support bar.

2. The system of claim 1, wherein:

said base support connectors are releasable connectors that are configured to allow assembly and disassembly of said base structure;

said base supports and said base support connectors are configured to form said base structure substantially in the form of a rectangle;

one or more of said base supports are between 10 centimeters (cm) and 100 cm in length; or one or more of said base supports are between 10 cm and 60 cm in length.

3. The system of claim 1, wherein:

said system further comprises one or more locking supports configured to releasably connect said raised supports to said base supports;

said support structure connectors comprise one or more pivot locks or thumb screws; or each of said support structure connectors, when engaging one of said raised supports to one of said base supports, is configured to allow or prevent translation of said raised support along the length of said base support or rotation of said raised support relative to said base support.

4. The system of claim 1, wherein:

said raised supports are substantially the same length;

said raised supports are substantially different lengths;

said raised supports are between 10 cm and 100 cm in length;

one or more of said raised supports are telescoping and configured to be extended and retracted; or one or more of said raised supports can be extended by between 5 and 20 cm in length.

5. The system of claim 1, wherein said raised supports comprise two or more positioners along the length of said raised supports for securing said limb support bars at pre-set locations.

6. The system of claim 5, wherein said positioners comprise grooves, holes, or indentations at said pre-set locations along all or a portion of the length of said raised supports, and wherein said limb support bar connectors are configured to fit within said grooves, holes, or indentations to lock said limb support bars at said pre-set location along said raised supports.

7. The system of claim 1, wherein:

said limb support bars are between 10 cm and 60 cm in length;

said limb support bars comprise one or more holes that bisect the central axis of said limb support bars;

said limb support bars comprise one or more holes that bisect the central axis of said limb support bars at or near their ends;

said limb support bars have substantially the same length;

said limb support bars have substantially different lengths;

said system further comprises two or more elongated tees configured to connect two or more limb support bars; or said limb support bar connectors are configured to allow movement of said limb support bars along the length of said raised supports when disengaged from said raised supports and to prevent downward movement of said limb supports bars when engaged with said raised supports.

8. The system of claim 1, wherein:

one or more of said raised supports, base supports, or limb support bars comprises radiolucent materials, metallic components, non-metallic components, non-magnetic components, paramagnetic components, or titanium components;

one or more of said raised supports, base supports, or limb support bars is plastic;

one or more of said base supports, raised supports, or limb support bars have a cross-sectional shape that is substantially circular or polygonal along all or a portion of their lengths;

one or more of said limb support bars is substantially straight; or one or more of said base supports, raised supports, or limb support bars are formed with a slight curvature.

9. The system of claim 1, further comprising a sterilization tray.

10. A method of sterilizing the system of claim 9, comprising heating the components of the system in said sterilization tray.

11. The method of claim 10, wherein said components are sterilized in an autoclave, or wherein said components are wrapped prior to said sterilizing.

12. A method of assembling the limb positioning device from the system of claim 1, the method comprising:

connecting said base support connectors to said base supports to form said base structure, wherein said base structure is substantially in the form of a planar parallelogram;

attaching two of said support structure connectors to two opposing sides of said base structure;

connecting one of the raised supports to each of said support structure connectors;

engaging first and second holes of said first limb support bar with said first pair of raised supports, and first and second holes of said second limb support bar with said second pair of raised supports;

translating said first limb support bar along a length of said first pair of raised supports, and said second limb support bar along a length of said second pair of raised supports; and affixing said first limb support bar to said first pair of raised supports and said second limb support bar to said second pair of raised supports with two or more of said limb support bar connectors.

13. The method of claim 12, wherein:

said support structure connectors allow rotation of said raised supports relative to said base structure;

said support structure connectors comprise a locking member;

one or more of said raised supports are telescoping and configured to be extended and retracted; or one or more of said raised supports can be extended by between 5 and 20 cm in length.

14. The method of claim 12, further comprising movably attaching a third limb support bar to the first pair of raised supports, wherein the first and third limb support bars are connected to each other by two or more said limb support bar connectors.

15. A method of adjusting the limb positioning device of claim 12, after assembly of said device, wherein said adjusting comprises:

releasing said first limb support bar from said first pair of raised supports, translating said first limb support bar along the lengths of said first pair of raised supports, and reaffixing said first limb support bar to said first pair of raised supports; or releasing said second limb support bar from the second pair of raised supports, translating said second limb support bar along the lengths of said second pair of raised supports, and reaffixing said second limb support bar to said second pair of raised supports.

16. The method of claim 15, wherein:

said limb support bar connectors comprise one or more pins or tees;

said adjusting further comprises loosening one or more of said support structure connectors connecting one or more of said raised supports to said base structure, rotating the angle of said one or more raised supports relative to the plane of said base structure, and tightening said support structure connectors;

two of said raised supports are adjusted, wherein said two raised supports are substantially parallel to one another before and after said adjusting;

said first and said second limb support bars are both adjusted;

said device comprises a third limb support bar that is affixed to said first pair of raised supports with two or more limb support bar connectors and is adjusted; or said device comprises a third limb support bar that is affixed to said first limb support bar with two or more limb support bar connectors and is adjusted.

17. The method of claim 15, wherein said limb support bars are translated between one or more pre-set locations, wherein said raised supports comprise positioners at said pre-set locations along all or a portion of the length of said raised supports;

said positioners comprise grooves, holes, or indentations; and said limb support bars are released from and reaffixed to said raised supports at said pre-set locations using a locking member configured to fit within said grooves, holes, or indentations.

18. The method of claim 15, wherein:

said first limb support bar and said second limb support bar can be translated along the length of said raised supports simultaneously; or said first limb support bar or said second limb support bar is affixed to said raised supports 10 cm or less from its ends.

19. The method of claim 15, wherein said adjusting comprises configuring said device to support a human leg.

20. The method of claim 19, wherein said second limb support bar is configured to support the portion of said human leg above the knee of the human, and said first limb support bar is configured to support the portion of said human leg below the knee of the human.

* * * * *